US010155322B2

(12) United States Patent
Egawa

(10) Patent No.: US 10,155,322 B2
(45) Date of Patent: Dec. 18, 2018

(54) PUNCHING DEVICE, SHEET PROCESSING DEVICE, IMAGE FORMING SYSTEM

(71) Applicant: KYOCERA Document Solutions Inc., Osaka-shi, Osaka (JP)

(72) Inventor: Keisuke Egawa, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/546,577

(22) PCT Filed: May 31, 2016

(86) PCT No.: PCT/JP2016/066005
§ 371 (c)(1),
(2) Date: Jul. 26, 2017

(87) PCT Pub. No.: WO2017/022311
PCT Pub. Date: Feb. 9, 2017

(65) Prior Publication Data

US 2018/0021968 A1 Jan. 25, 2018

(30) Foreign Application Priority Data

Aug. 6, 2015 (JP) ..... 2015-155907

(51) Int. Cl.
*B26F 1/04* (2006.01)
*B26D 5/06* (2006.01)
(Continued)

(52) U.S. Cl.
CPC ..... *B26D 5/06* (2013.01); *B26F 1/04* (2013.01); *B26F 1/14* (2013.01); *B65H 7/02* (2013.01);
(Continued)

(58) Field of Classification Search
None
See application file for complete search history.

(56) References Cited

U.S. PATENT DOCUMENTS 5,253,030 A * 10/1993 Shigemura ..... B26D 7/015 399/407
6,907,806 B1 * 6/2005 Okamoto ..... B26D 5/28 83/210
(Continued)

FOREIGN PATENT DOCUMENTS

JP 2009029619 A 2/2009

*Primary Examiner* — Sean Michalski
(74) *Attorney, Agent, or Firm* — Alleman Hall Creasman & Tuttle LLP

(57) ABSTRACT

In a first punching mode, a control portion displaces a support member from a first-path-side end side to a second-path-side end side, and causes a first punching portion on the first-path-side end side to operate in a state where the support member has reached a first target position. In a second punching mode, the control portion displaces the support member from the second-path-side end side to the first-path-side end side, and causes a second punching portion on the second-path-side end side to operate in a state where the support member has reached a second target position. The first and second target positions are based on positions of the support member at points of time when edges on the first-path-side end side and the second-path-side end side are detected by the first sheet sensor and the second sheet sensor, respectively.

6 Claims, 16 Drawing Sheets

(51) Int. Cl.

| | |
|---|---|
| ***B65H 37/04*** | (2006.01) |
| ***B65H 7/10*** | (2006.01) |
| ***B26F 1/14*** | (2006.01) |
| ***B65H 7/02*** | (2006.01) |
| ***B65H 35/00*** | (2006.01) |
| *B26D 7/00* | (2006.01) |

(52) U.S. Cl.
CPC ..... *B65H 7/10* (2013.01); *B65H 35/008* (2013.01); *B65H 37/04* (2013.01); *B26D 2007/0018* (2013.01); *B65H 2801/06* (2013.01)

(56) References Cited

U.S. PATENT DOCUMENTS

| | | | | |
|---|---|---|---|---|
| 7,578,498 | B2 * | 8/2009 | Iguchi | B26D 5/32 270/58.07 |
| 7,703,766 | B2 * | 4/2010 | Kao | B65H 7/06 271/227 |
| 8,567,775 | B2 * | 10/2013 | Banal | B65H 9/103 271/228 |
| 9,195,478 | B2 * | 11/2015 | Yasui | G06F 9/4446 |
| 9,296,584 | B2 * | 3/2016 | Banai | B65H 29/125 |
| 2007/0069448 | A1 * | 3/2007 | Honda | B65H 31/10 271/145 |
| 2009/0033028 | A1 | 2/2009 | Yahata et al. | |
| 2011/0277604 | A1 | 11/2011 | Yahata et al. | |
| 2018/0072521 | A1 * | 3/2018 | Okubo | B65H 3/0661 |
| 2018/0170699 | A1 * | 6/2018 | Yamasaki | B41J 2/2135 |
| 2018/0194578 | A1 * | 7/2018 | Nakamura | B65H 3/128 |

* cited by examiner

PUNCHING DEVICE, SHEET PROCESSING DEVICE, IMAGE FORMING SYSTEM

TECHNICAL FIELD

The present invention relates to a punching device, a sheet processing device, and an image forming system including the same.

BACKGROUND ART

There is generally known a sheet processing device connected to an image forming apparatus. The sheet processing device is called, for example, a post-processing device. The sheet processing device includes, for example, a punching device. The punching device performs a punching process on a sheet member conveyed from the image forming apparatus.

In addition, there is known that, in the punching device, a plurality of punching portions and a sensor are supported on a support member that can be displaced in the width direction of the sheet member, and the plurality of punching portions perform the punching simultaneously at a plurality of spots on the sheet member. In this case, the sensor detects an end of the sheet member in the width direction of the sheet member. Furthermore, the support member is positioned based on a position at a point in time when an end of the sheet member was detected by the sensor. In this state, the plurality of punching portions operate simultaneously (see, for example, PTL 1).

CITATION LIST

Patent Literature

[PTL 1] Japanese Patent Application Publication No. 2009-29619

SUMMARY OF THE INVENTION

Problems to be Solved by the Invention

Meanwhile, a conventional punching device forms holes at a plurality of spots on the sheet member along a direction perpendicular to the conveyance direction of the sheet member. As a result, when holes are to be formed at a plurality of spots on the sheet member along its longitudinal direction, the sheet member needs to be conveyed laterally.

In a case where the sheet member is conveyed laterally, a larger device is required than a case where the sheet member is conveyed longitudinally.

The present invention has been made in view of such conventional circumstances, and it is an object of the present invention to provide a punching device that can perform the punching at a plurality of spots along the longitudinal direction of the sheet member with a more compact configuration, a sheet processing device, and an image forming system including the same.

Solution to the Problems

A punching device according to an aspect of the present invention includes a support member, a displacement mechanism, a first sheet sensor, a second sheet sensor, a first punching portion, a second punching portion, a punching mode selection portion, and a control portion. The support member faces a conveyance path of a sheet member conveyed in a first direction. The support member is formed to extend from a position close to one of a first-path-side end and a second-path-side end to a position close to the other. The first-path-side end is a first side end of the conveyance path in a second direction perpendicular to the first direction. The second-path-side end is a second side end of the conveyance path in the second direction. The displacement mechanism causes the support member to be displaced reciprocally along the second direction. The first sheet sensor is supported on the support member at a position close to the first-path-side end and, when the support member is displaced, detects a first edge of the sheet member that is located on the first-path-side end side. The second sheet sensor supported on the support member at a position close to the second-path-side end and detects, when the support member is displaced, a second edge of the sheet member that is located on the second-path-side end side. The first punching portion is supported on the support member at a position close to the first-path-side end and performs punching on the sheet member. The second punching portion is supported on the support member at a position close to the second-path-side end and performs punching on the sheet member. The punching mode selection portion executes a process of selecting a first punching mode or a second punching mode. The first punching mode is an operation mode in which a conveyance-direction punching process is executed on a part of the sheet member that is on the first edge side. The second punching mode is an operation mode in which the conveyance-direction punching process is executed on a part of the sheet member that is on the second edge side. In the conveyance-direction punching process, the punching is performed on the sheet member in sequence at a plurality of spots along the first direction. The control portion causes the displacement mechanism, the first punching portion, and the second punching portion to execute the conveyance-direction punching process. In a case where the first punching mode has been selected, the control portion causes the displacement mechanism to displace the support member from the first-path-side end side to the second-path-side end side. Furthermore, the control portion causes the first punching portion to operate in a state where the support member has reached a first target position. The first target position is based on a position of the support member at a point of time when the first edge is detected by the first sheet sensor. In a case where the second punching mode has been selected, the control portion causes the displacement mechanism to displace the support member from the second-path-side end side to the first-path-side end side. Furthermore, the control portion causes the second punching portion to operate in a state where the support member has reached a second target position. The second target position is based on a position of the support member at a point of time when the second edge is detected by the second sheet sensor.

A sheet processing device according to another aspect of the present invention includes the punching device that performs punching on a sheet member conveyed from an image forming apparatus. The image forming apparatus forms an image on the sheet member.

An image forming system according to a further aspect of the present invention includes the image forming apparatus and the sheet processing device.

Advantageous Effects of the Invention

According to the present invention, it is possible to provide a punching device that can perform the punching at a plurality of spots along the longitudinal direction of the sheet member with a more compact configuration, a sheet processing device, and an image forming system including the same.

DESCRIPTION OF EMBODIMENTS

The following describes embodiments of the present invention with reference to the accompanying drawings for the understanding of the invention. It should be noted that the following embodiments are an example of a specific embodiment of the present invention and should not limit the technical scope of the present invention.

[First Embodiment]

Figure 1:
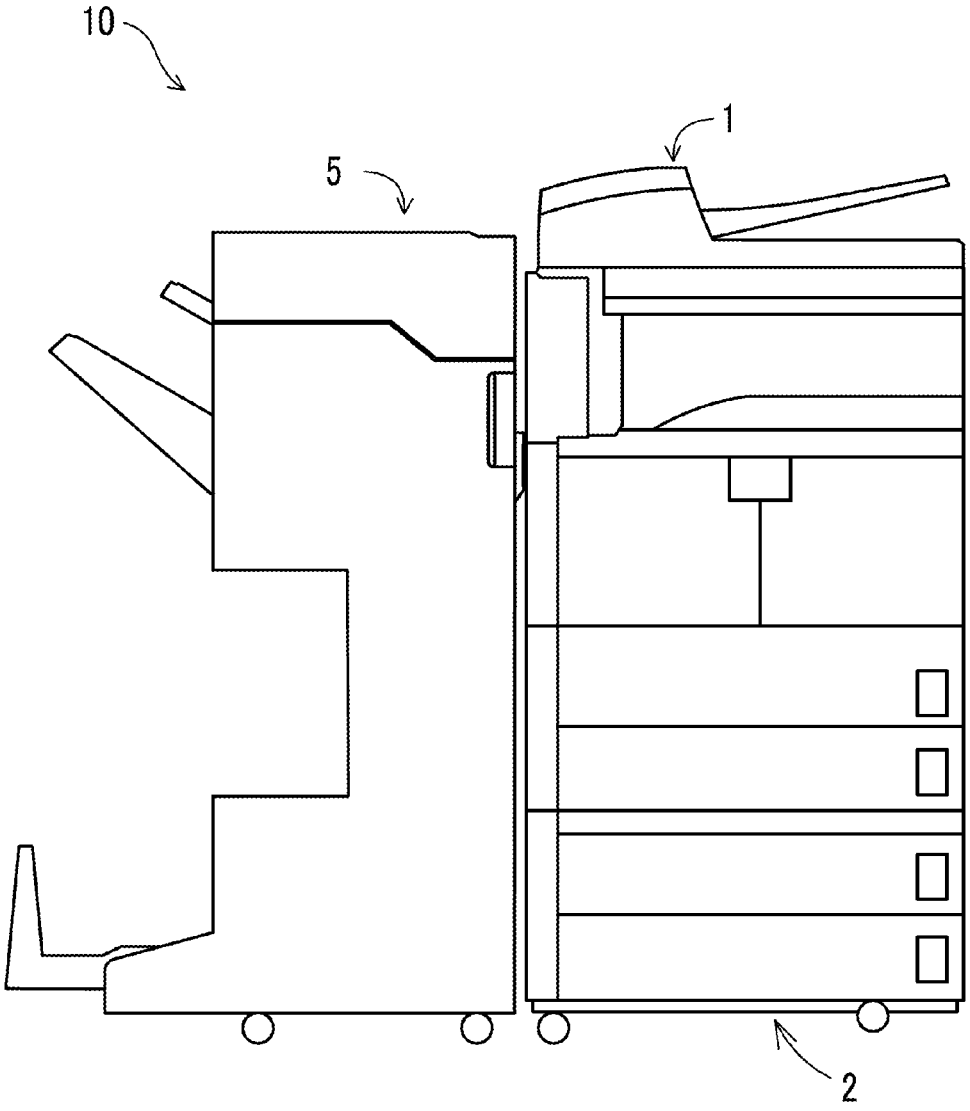
FIG. 1 is a configuration diagram of an image forming system including a punching device according to embodiments.
Figure 2:
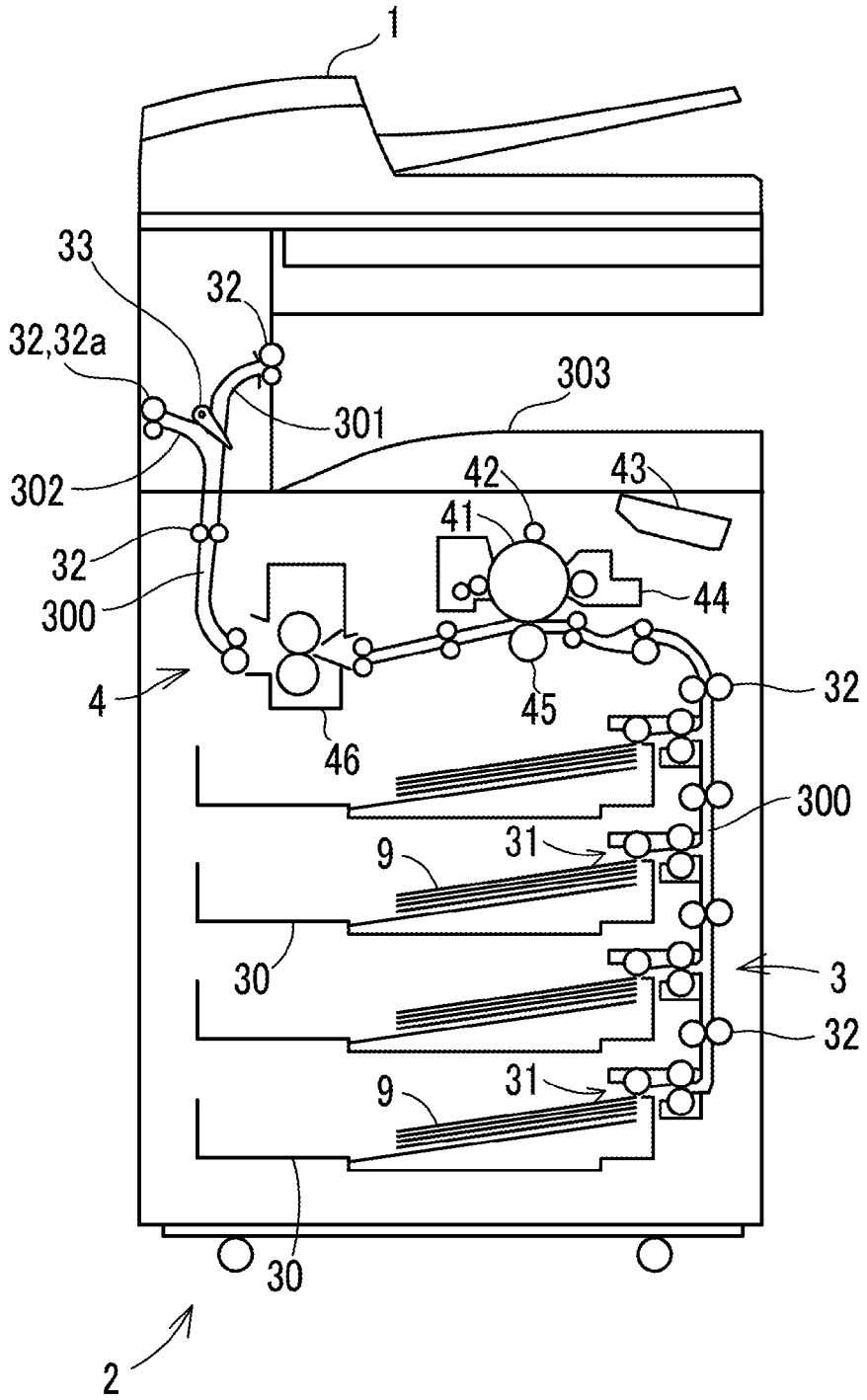
FIG. 2 is a configuration diagram of an image reading device and an image forming device.
Figure 3:
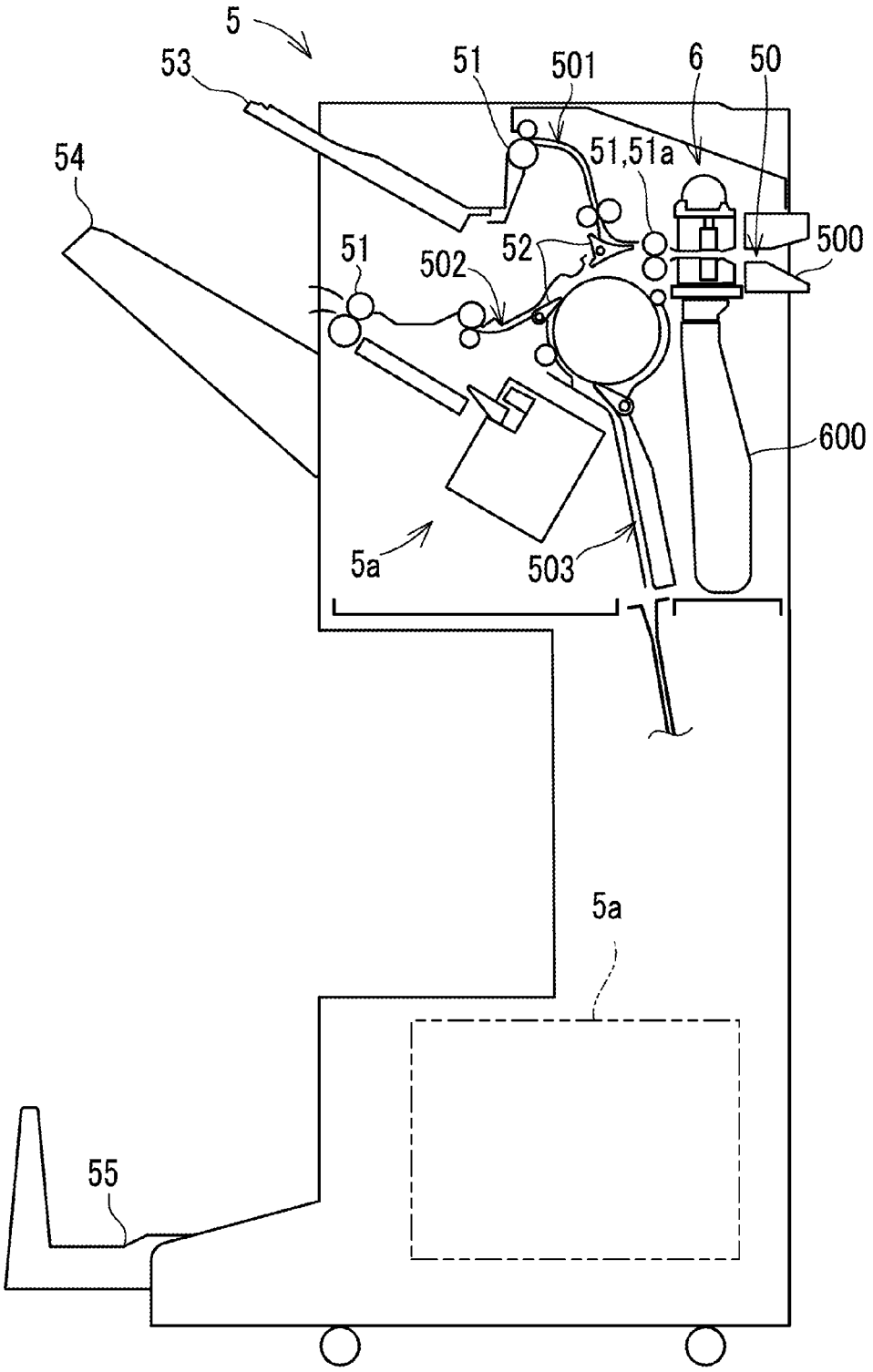
FIG. 3 is a configuration diagram of a sheet processing device including a punching device according to a first embodiment.

First, a description is given of a configuration of an image forming system 10 including a punching device 6 according to a first embodiment, with reference to FIG. 1 to FIG. 3.

[Image Forming System 10]

The image forming system 10 includes an image reading device 1, an image forming device 2, and a sheet processing device 5. The image forming system 10 shown in FIG. 1 is a multifunction peripheral. The image forming system 10 may be a printer, a copier, or a facsimile apparatus that includes the sheet processing device 5. The multifunction peripheral has a function of the printer, a function of the copier and the like.

[Image Reading Device 1 and Image Forming Device 2]

The image reading device 1 reads an image from a document sheet. In a case where the image forming system 10 executes a copy process, the image forming device 2 forms an image on a sheet member 9 based on image data of the document sheet output from the image reading device 1. In addition, the image forming device 2 may form an image on a sheet member 9 based on a print job received from a terminal (not shown).

As shown in FIG. 2, the image forming device 2 includes a sheet conveying portion 3 and an image forming portion 4. The image forming device 2 performs an image formation by an electrophotographic system. It is noted that the image forming device 2 may perform an image formation by another system such as an ink jet system.

In the sheet conveying portion 3, a plurality of sheet members 9 are stored in a sheet receiving portion 30 in a stacked state. It is noted that the sheet member 9 is a sheet-like image formation medium such as a sheet of paper, a sheet of coated paper, a postcard, an envelope, or an OHP sheet. A sheet feed portion 31 feeds a sheet member 9 from the sheet receiving portion 30 toward a sheet conveyance path 300.

A conveyance roller 32 of the sheet conveying portion 3 conveys the sheet member 9 toward the image forming portion 4. Subsequently, the conveyance roller 32 conveys the sheet member 9 after an image formation from the sheet conveyance path 300 onto a discharge tray 303 or to the sheet processing device 5. It is noted that the conveyance roller 32 includes a pair of rollers that rotate while nipping the sheet member 9 therebetween.

A movable guide 33 of the sheet conveying portion 3 is displaced by a driving source (not shown) such as a solenoid. This allows the movable guide 33 to selectively switch between two conveyance paths for conveying the sheet member 9 after image formation. The two conveyance paths are: a conveyance path that extends from the sheet conveyance path 300 to a discharge tray 303 of the image forming device 2; and a conveyance path that extends from the sheet conveyance path 300 to the sheet processing device 5.

The image forming portion 4 forms an image on a surface of the sheet member 9 that is moving in the sheet conveyance path 300. In the image forming portion 4, a charging portion 42 charges a surface of a photoconductor 41 uniformly while the photoconductor 41 is rotating. Furthermore, a laser scanning portion 43 writes an electrostatic latent image on the surface of the photoconductor 41 by irradiation of a laser beam. A developing portion 44 develops the electrostatic latent image by supplying developer to the photoconductor 41.

Furthermore, a transfer portion 45 transfers the image of the developer formed on the surface of the photoconductor 41, to the sheet member 9. Thereafter, a fixing portion 46 heats the developer image on the sheet member 9 so as to fix the image to the sheet member 9.

[Sheet Processing Device 5]

The sheet processing device 5 performs sheet processing on the sheet member 9 conveyed from the image forming device 2. The sheet processing includes punching of the sheet member 9.

In the example shown in FIG. 3, the sheet processing device 5 includes a stapling device 5*a* and a sheet folding device 5*b*, as well as the punching device 6 configured to execute the punching. It is noted that in FIG. 3, a configuration diagram of the sheet folding device 5*b* is omitted.

The sheet processing device 5 may include a mechanism that conveys the sheet member 9 set in a tray (not shown) to an execution position of the sheet processing. In this case, the sheet processing device 5 can execute the sheet processing singly, not accompanying the image forming device 2.

The sheet processing device 5 includes a conveyance roller 51, a movable guide 52, the punching device 6, the stapling device 5*a*, the sheet folding device 5*b*, a first discharge tray 53, a second discharge tray 54, and a third discharge tray 55. It is noted that the conveyance roller 51 includes a pair of rollers that rotate while nipping the sheet member 9 therebetween.

In the sheet processing device 5, conveyance paths of the sheet member 9 are formed, wherein the conveyance paths include a main conveyance path 50, a first conveyance path 501, a second conveyance path 502, and a third conveyance path 503.

The conveyance roller 51 conveys the sheet member 9 along the first conveyance path 501, the second conveyance path 502, and the third conveyance path 503. The sheet member 9 conveyed from the image forming device 2 enters into the main conveyance path 50 from a sheet introduction port 500 of the sheet processing device 5. The sheet introduction port 500 communicates with an outlet port of the sheet conveyance path 300 in the image forming device 2.

The movable guide 52 is displaced by a driving source (not shown) such as a solenoid. This allows the movable guide 52 to selectively switch among next conveyance paths along which the sheet member 9 is to be conveyed after being conveyed along the main conveyance path 50. The next conveyance paths include the first conveyance path 501, the second conveyance path 502, and the third conveyance path 503.

The punching device 6 performs the punching on the sheet member 9 conveyed from the image forming device 2 along the main conveyance path 50. The punching device 6 includes a collection container 600 in a lower portion thereof. With the punching, sheet pieces are cut out from the sheet member 9.

The sheet pieces generated by the punching drop from the main conveyance path 50 and are collected in the collection container 600. The collection container 600 is detachably attached to the sheet processing device 5.

In the following description, conveyance rollers disposed immediately in front of and immediately in rear of the punching device 6 are respectively referred to as a front conveyance roller 32*a* and a rear conveyance roller 51*a*. The front conveyance roller 32*a* and the rear conveyance roller 51*a* convey the sheet member 9 along the main conveyance path 50.

The sheet member 9 conveyed from the main conveyance path 50 to the first conveyance path 501 is directly discharged to the first discharge tray 53 by the conveyance roller 51.

The stapling device 5*a* aligns and holds a plurality of sheet members 9 conveyed to the second conveyance path 502, and performs a stapling process on the sheet members 9. The sheet members 9 having been subjected to the stapling process are discharged to the second discharge tray 54 by the conveyance roller 51.

The sheet folding device 5*b* executes a sheet folding process of folding, in two or three, the sheet member 9 conveyed to the third conveyance path 503. The sheet member 9 having been subjected to the sheet folding process is discharged to the third discharge tray 55 by the conveyance roller 51.

Meanwhile, a conventional punching device forms holes at a plurality of spots on the sheet member 9 along a direction perpendicular to the conveyance direction of the sheet member 9. As a result, when holes are to be formed at a plurality of spots on the sheet member 9 along its longitudinal direction, the sheet member 9 needs to be conveyed laterally.

In a case where the sheet member 9 is conveyed laterally, a larger device is required than a case where the sheet member 9 is conveyed longitudinally.

It is noted that in a case where the sheet member 9 is conveyed laterally, it is conveyed in an orientation where one of its long sides becomes the forward end and the other becomes the rearward end. In a case where the sheet member 9 is conveyed longitudinally, the sheet member 9 is conveyed in an orientation where one of its short sides becomes the forward end and the other becomes the rearward end.

On the other hand, the punching device 6 can perform the punching at a plurality of spots along the longitudinal direction of the sheet member 9, with a more compact configuration.

[Configuration of Punching Device 6]

Figure 4:
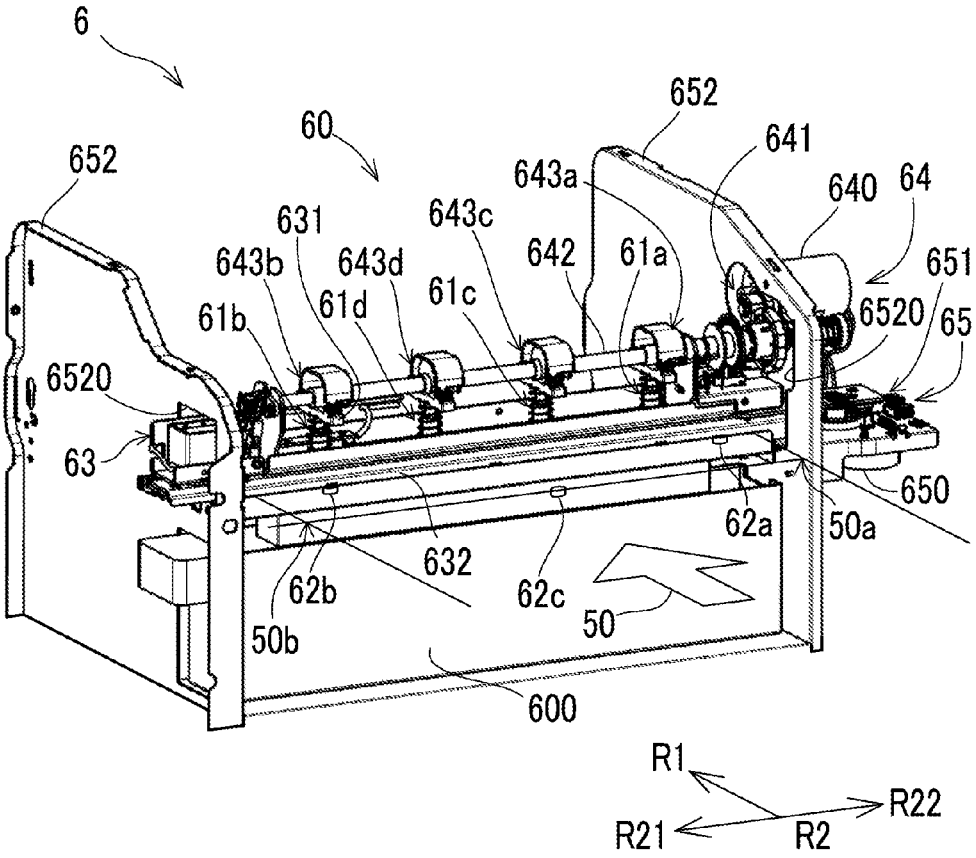
FIG. 4 is a perspective view of the punching device according to the first embodiment.
Figure 5:
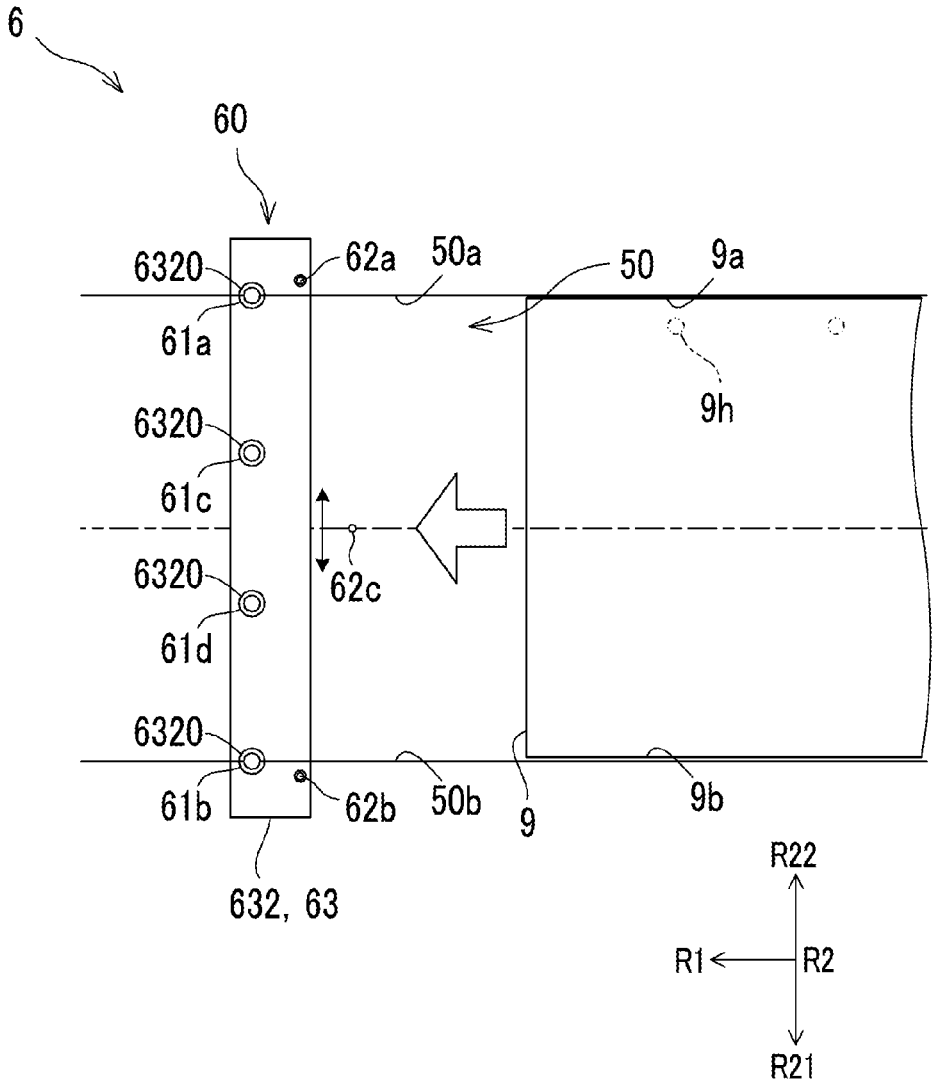
FIG. 5 is a schematic plan view of a part of a punching unit in the punching device according to the first embodiment.
Figure 6:
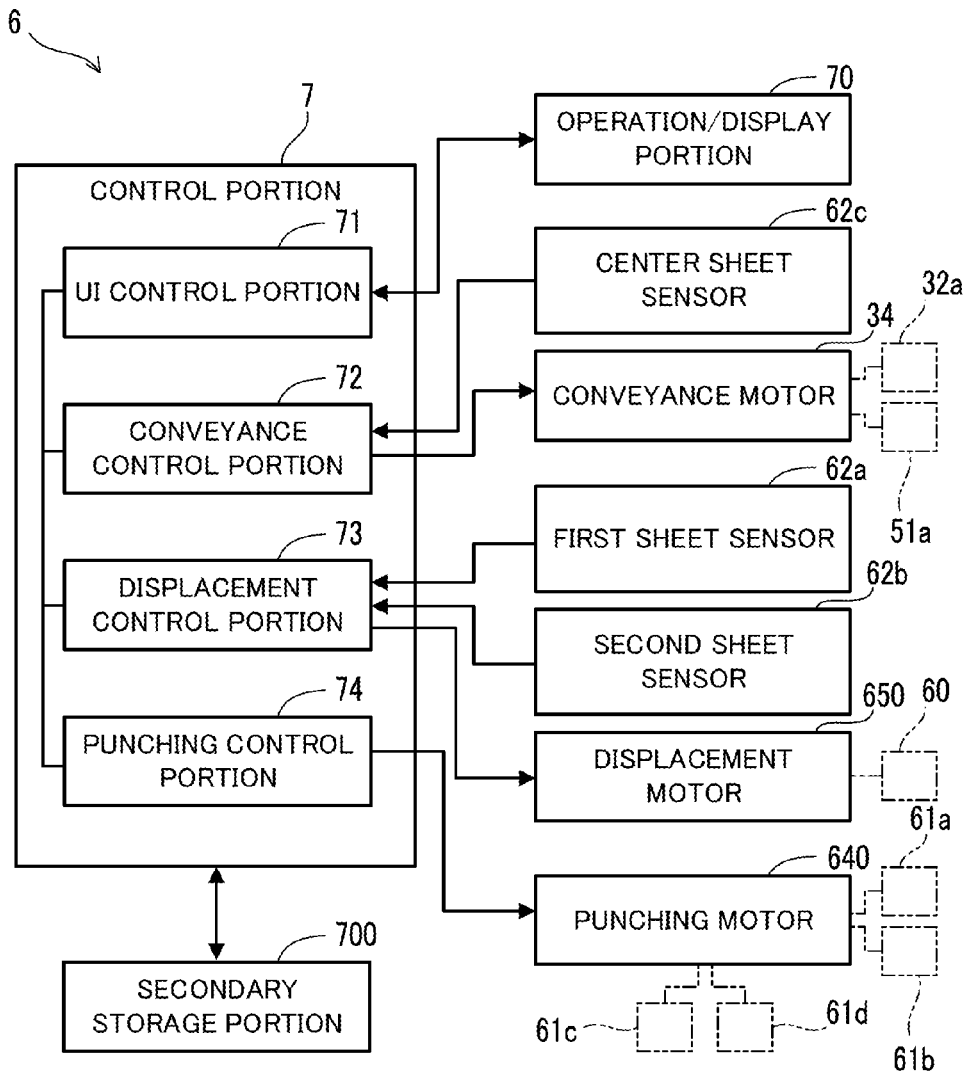
FIG. 6 is a block diagram of control-related equipment in the punching device according to the first embodiment.

The following describes a configuration of the punching device 6 with reference to FIG. 4 to FIG. 6. In the following description, a conveyance direction of the sheet member 9 in the main conveyance path 50 is referred to as a first direction R1. In addition, a direction perpendicular to the first direction R1 is referred to as a second direction R2. The second direction R2 is the width direction of the sheet member 9 when the sheet member 9 is moving in the main conveyance path 50.

In addition, a first side end and a second side end of the main conveyance path 50 in the second direction R2 are referred to as a first-path-side end 50*a* and a second-path-side end 50*b*, respectively. An interval between the first-path-side end 50*a* and the second-path-side end 50*b* is obtained by adding a slight margin to the width of the sheet member 9 of the maximum size that can pass through the main conveyance path 50.

In the examples shown in the drawings, the right end of the main conveyance path 50 facing in the first direction R1 is indicated as the first-path-side end 50*a*. In addition, the left end of the main conveyance path 50 facing in the first direction R1 is indicated as the second-path-side end 50*b*.

The punching device 6 includes a punching unit 60 and a displacement mechanism 65. The punching unit 60 includes a plurality of punching portions 61*a*, 61*b*, 61*c* and 61*d*, a plurality of sheet sensors 62*a*, 62*b*, a support member 63, and a punching driving portion 64.

The support member 63 supports equipment that constitutes the punching unit 60. The support member 63 faces the main conveyance path 50, and is formed to extend from a position close to the first-path-side end 50*a* to a position close to the second-path-side end 50*b*.

The plurality of punching portions 61*a*, 61*b*, 61*c* and 61*d* perform the punching on the sheet member 9 conveyed along the main conveyance path 50. The punching portions 61*a*, 61*b*, 61*c* and 61*d* are supported on the support member 63. The support member 63 includes individual support portions 631 that respectively support the punching portions 61*a*, 61*b*, 61*c* and 61*d*.

In the present embodiment, the punching device 6 includes four punching portions 61*a*, 61*b*, 61*c* and 61*d*. A first punching portion 61*a* is supported at a position close to the first-path-side end 50*a* in the support member 63. A second punching portion 61*b* is supported at a position close to the second-path-side end 50*b* in the support member 63.

In addition, a third punching portion 61*c* and a fourth punching portion 61*d* are supported between the first punching portion 61*a* and the second punching portion 61*b* in the support member 63. It is noted that one punching portion or three or more punching portions may be supported between the first punching portion 61*a* and the second punching portion 61*b* in the support member 63.

The punching portions 61*a*, 61*b*, 61*c* and 61*d* are supported in such a way as to be displaced reciprocally between a retreat position and an operation position. The retreat position is distant from the sheet member 9 in the main conveyance path 50, and the punching portions at the operation position pass through the sheet member 9 in the main conveyance path 50. For example, the punching portions 61*a*, 61*b*, 61*c* and 61*d* may be punching blades supported by a spring(s). In this case, an elastic force that returns the punching blades from the operation position to the retreat position, is applied from the spring(s) to the punching blades.

The punching driving portion 64 is a mechanism that causes the punching portions 61*a*, 61*b*, 61*c* and 61*d* to be displaced reciprocally between the retreat position and the operation position. The punching driving portion 64 includes a punching motor 640, a first link portion 641, a shaft 642, and a plurality of second link portions 643*a*, 643*b*, 643*c* and 643*d*. The punching motor 640 is, for example, a servo motor.

The first link portion 641 transmits the driving force of the punching motor 640 to the shaft 642. This allows the shaft 642 to rotate. The second link portions 643*a*, 643*b*, 643*c* and 643*d* each convert the rotational force of the shaft 642 to a force that presses each of the punching portions 61*a*, 61*b*, 61*c* and 61*d* to the operation position, respectively.

In the present embodiment, the second link portions 643*a* and 643*b* corresponding to the first punching portion 61*a* and the second punching portion 61*b* operate simultaneously in response to a first operation of the punching motor 640. In addition, the second link portions 643*c* and 643*d* corresponding to the third punching portion 61*c* and the fourth punching portion 61*d* operate simultaneously in response to a second operation of the punching motor 640.

That is, the first punching portion 61*a* and the second punching portion 61*b* operate in conjunction with each other in response to the first operation of the punching motor 640. The third punching portion 61*c* and the fourth punching portion 61*d* operate in conjunction with each other in response to the second operation of the punching motor 640. The first punching portion 61*a* and the second punching portion 61*b* operate independently of the third punching portion 61*c* and the fourth punching portion 61*d*.

For example, the punching device 6 may include a solenoid (not shown) that switches between the first operation and the second operation. In addition, the first operation and the second operation of the punching motor 640 may each a half turn in a range of a different half of the circumference. In that case, two second link portions 643*a* and 643*b* may be a cam mechanism that operates in conjunction with the shaft 642 when the shaft 642 rotates in a range of a half of the circumference. Similarly, the other two second link portions 643*c* and 643*d* may be a cam mechanism that operates in conjunction with the shaft 642 when the shaft 642 rotates in a range of the other half of the circumference.

The support member 63 includes a punching die 632 in a lower portion thereof. It is noted that FIG. 5, FIG. 9, FIG. 10, FIG. 11 and FIG. 13 show the punching die 632, the punching portions 61*a*, 61*b*, 61*c* and 61*d*, a first sheet sensor 62*a*, a second sheet sensor 62*b*, and a center sheet sensor 62*c* of the punching unit 60.

The punching die 632 is a flat plate-like member. In the punching die 632, a plurality of through holes 6320 respectively corresponding to the punching portions 61*a*, 61*b*, 61*c* and 61*d* are formed. The punching portions 61*a*, 61*b*, 61*c* and 61*d* pierce the through holes 6320 of the punching die 632 by being displaced from the retreat position to the operation position.

A space between the punching die 632 and the punching portions 61*a*, 61*b*, 61*c* and 61*d* at the retreat position constitutes a part of the main conveyance path 50. In a state where the sheet member 9 has reached a position along the punching die 632, the punching portions 61*a*, 61*b*, 61*c* and 61*d* are displaced from the retreat position to the operation position. This allows punching holes 9*h* to be formed in the sheet member 9. In addition, in FIG. 5 or the like, the punching holes 9*h* represented by a two-dot chain line indicate that they are planned to be formed in the sheet member 9.

The punching device 6 has a function to execute a width-direction punching process and a conveyance-direction punching process. In the width-direction punching process, the punching is performed on the sheet member 9 at a plurality of spots along the second direction R2 simultaneously.

In the punching device 6, the third punching portion 61*c* and the fourth punching portion 61*d* are used in the punching in the width-direction punching process.

In the conveyance-direction punching process, the punching is performed on the sheet member 9 in sequence at a plurality of spots along the first direction.

In the punching device 6, the first punching portion 61*a* and the second punching portion 61*b* are used in the punching in the conveyance-direction punching process.

The displacement mechanism 65 causes the support member 63 to be displaced reciprocally along the second direction R2. That is, the displacement mechanism 65 can cause the punching unit 60 to be displaced reciprocally along the second direction R2, and stop at a target position. In the following description, the position of the support member 63 along the second direction R2 means the same as the position of the punching unit 60 along the second direction R2.

The displacement mechanism 65 includes a displacement motor 650, a link portion 651, and a support frame 652. The displacement motor 650 is, for example, a stepping motor or a servo motor.

The support frame 652 supports the support member 63 such that the support member 63 can be displaced along the second direction R2. In the example shown in FIG. 4, a pair of support frames 652 are disposed at both sides of the main conveyance path 50. The support member 63 is inserted in openings 6520 that are respectively formed in the pair of support frames 652. The support member 63 is supported by lower rim portions of the openings 6520 of the pair of support frames 652.

The link portion 651 connects the displacement motor 650 to the support member 63, and causes the support member 63 to be displaced along the second direction R2 based on a rotation of the displacement motor 650. In the following description, a direction directed from the first-path-side end 50*a* side to the second-path-side end 50*b* side is referred to as a first displacement direction R21, and a direction opposite to the first displacement direction R21 is referred to as a second displacement direction R22. In other words, the first displacement direction R21 is a direction directed from the first-path-side end 50*a* side to an inner side of the main conveyance path 50. Similarly, the second displacement direction R22 is a direction directed from the second-path-side end 50*b* side to an inner side of the main conveyance path 50.

The first sheet sensor 62*a* and the second sheet sensor 62*b* supported on the support member 63 are, in conjunction with the support member 63, displaced reciprocally along the second direction R2.

The first sheet sensor 62*a* is supported on the support member 63 at a position close to the first-path-side end 50*a*. The second sheet sensor 62*b* is supported on the support member 63 at a position close to the second-path-side end 50*b*.

The first sheet sensor 62*a* detects a first edge 9*a* of the sheet member 9 when the support member 63 is displaced in the first displacement direction R21. The first edge 9*a* is an edge of the sheet member 9 located on the first-path-side end 50*a* side.

The second sheet sensor 62*b* detects a second edge 9*b* of the sheet member 9 when the support member 63 is displaced in the second displacement direction R22. The second edge 9*b* is an edge of the sheet member 9 located on the second-path-side end 50*b* side.

The center sheet sensor 62*c* detects a forward end of the sheet member 9 conveyed along the main conveyance path 50.

The center sheet sensor 62*c* is fixed to a support portion (not shown) at a position on the upstream side of the first sheet sensor 62*a* and the second sheet sensor 62*b* in the first direction R1. In addition, the center sheet sensor 62*c* is fixed at a position between the first-path-side end 50*a* and the second-path-side end 50*b* in the second direction R2.

In the present embodiment, various sizes of sheet members 9 are conveyed along the main conveyance path 50 in a so-called center alignment. That is, the sheet member 9 is conveyed in a state where the center of the sheet member 9 in the width direction approximately matches the center of the main conveyance path 50 in the second direction R2. In this case, the center sheet sensor 62*c* may be fixed at the center position of the main conveyance path 50 in the second direction R2.

The first sheet sensor 62*a*, the second sheet sensor 62*b*, and the center sheet sensor 62*c* are disposed opposite to the main conveyance path 50. For example, the first sheet sensor 62*a*, the second sheet sensor 62*b*, and the center sheet sensor 62*c* are reflection-type photosensors or transmission-type photosensors.

The detection result of the first sheet sensor 62*a* is used as a reference for positioning the support member 63 in the second direction R2 in a case where the punching holes 9*h* are formed in a part of the sheet member 9 that is close to the first edge 9*a*.

The detection result of the second sheet sensor 62*b* is used as a reference for positioning the support member 63 in the second direction R2 in a case where the punching holes 9*h* are formed in a part of the sheet member 9 that is close to the second edge 9*b*.

The detection result of the center sheet sensor 62*c* is used as a reference for positioning the sheet member 9 in the first direction R1 in a case where the punching holes 9*h* are formed in the sheet member 9. In the present embodiment, the front conveyance roller 32*a* and the rear conveyance roller 51*a* stop the sheet member 9 at a target position in the first direction R1.

[Configuration of Control-Related Equipment]

Next, a description is given of control-related equipment in the punching device 6 with reference to FIG. 6. The punching device 6 includes a control portion 7, a secondary storage portion 700, and an operation/display portion 70.

The operation/display portion 70 is a user interface (UI) device. The operation/display portion 70 includes an operation portion and a display portion, wherein the operation portion includes, for example, a touch panel and operation buttons and is used for inputting information, and the display portion is panel-like and is, for example, a liquid crystal panel.

The control portion 7 controls various electric devices included in the punching device 6. The control portion 7 includes a UI control portion 71, a conveyance control portion 72, a displacement control portion 73, and a punching control portion 74. The UI control portion 71, the conveyance control portion 72, the displacement control portion 73, and the punching control portion 74 can mutually transmit and receive information via a bus or a shared memory.

The UI control portion 71 controls the operation/display portion 70. For example, the UI control portion 71 displays an operation menu or the like on the operation/display portion 70. Furthermore, the UI control portion 71 passes over input information that has been input via an operation on the operation/display portion 70, to another control portion.

The conveyance control portion 72 controls a conveyance motor 34 that drives the front conveyance roller 32*a* and the rear conveyance roller 51*a*. The conveyance control portion 72 controls the conveyance motor 34 based on the detection result of the center sheet sensor 62*c*. This allows the conveyance control portion 72 to stop the sheet member 9 at a target position in the main conveyance path 50.

The displacement control portion 73 controls the displacement motor 650 based on the detection results of the first sheet sensor 62*a* and the second sheet sensor 62*b*. This allows the displacement control portion 73 to displace the punching unit 60 to a target position in the second direction R2.

The punching control portion 74 causes the punching portions 61*a*, 61*b*, 61*c* and 61*d* to perform the punching by controlling the punching motor 640.

As described below, the conveyance control portion 72, the displacement control portion 73, and the punching control portion 74 of the control portion 7 cause the displacement mechanism 65, the first punching portion 61*a* and the second punching portion 61*b* to execute the conveyance-direction punching process.

For example, the control portion 7 includes a MPU (Micro Processor Unit) and a RAM (Random Access Memory), wherein the MPU executes a program stored in advance in the secondary storage portion 700. The RAM is a volatile main storage portion for temporarily storing a program that is executed by the MPU.

The MPU that executes a control program of the operation/display portion 70 may function as the UI control portion 71. Similarly, the MPU that executes a control program of the conveyance motor 34 may function as the conveyance control portion 72.

Similarly, the MPU that executes a control program of the displacement motor 650 may function as the displacement control portion 73. Similarly, the MPU that executes a control program of the punching motor 640 may function as the punching control portion 74.

In addition, the UI control portion 71, the conveyance control portion 72, the displacement control portion 73, and the punching control portion 74 may be composed of a DSP (Digital Signal Processor), an ASIC (Application Specific Integrated Circuit) or the like.

The secondary storage portion 700 is a nonvolatile storage portion for storing various types of information that are referenced by the control portion 7. In addition, the secondary storage portion 700 is also a storage portion from/to which the control portion 7 can read and write various types of information.

It is noted that in the present embodiment, the control portion 7 serves as a control portion that controls the image reading device 1 and the image forming device 2. As a result, the control portion 7 includes other components (not shown) that are related to the control of the image reading device 1 and the image forming device 2.

[Image Formation/Punching Process]

Figure 7:
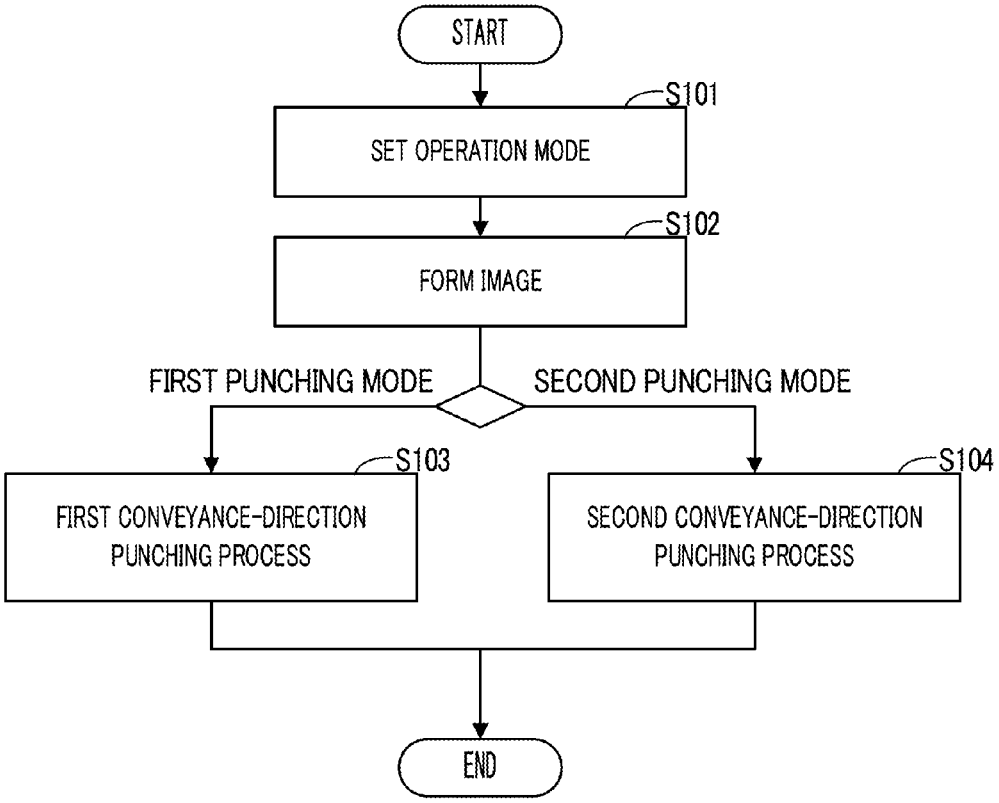
FIG. 7 is a flowchart showing an example of a procedure of an image formation/punching process in the image forming system including the punching device according to the first embodiment.

Next, an example of the procedure of the image formation/punching process executed by the image forming device 2 and the punching device 6, is described with reference to the flowchart shown in FIG. 7.

In the image formation/punching process, an image is formed on the sheet member 9, and the punching is performed on the sheet member 9 after the image formation.

In the following description, S101, S102, . . . are identification signs representing the steps executed by the control portion 7. The image formation/punching process is started when a predetermined start operation is performed on the operation/display portion 70.

<Step S101>

First, the UI control portion 71 executes an operation mode setting process. The operation mode setting process includes a punching mode selection process in which a first punching mode or a second punching mode is selected as an operation mode of the conveyance-direction punching process. It is noted that the UI control portion 71 executing the process of step S101 is an example of the punching mode selection portion.

The first punching mode is an operation mode in which the conveyance-direction punching process is executed on a part of the sheet member 9 that is on the first edge 9*a* side. The second punching mode is an operation mode in which the conveyance-direction punching process is executed on a part of the sheet member 9 that is on the second edge 9*b* side.

For example, the UI control portion 71 displays a predetermined selection menu screen on the display portion of the operation/display portion 70. Furthermore, the UI control portion 71 selects either the first punching mode or the second punching mode in accordance with an operation performed on the operation portion of the operation/display portion 70.

It is noted that in the operation mode setting process, an operation mode of the width-direction punching process may be selected as the punching mode. However, a description of the operation mode of the width-direction punching process is omitted.

Upon receiving a predetermined confirming operation performed on the operation/display portion 70, the UI control portion 71 moves the process to step S102.

<Step S102>

Next, a print control portion (not shown) of the control portion 7 causes the image forming portion 4 to execute an image forming process. This allows an image to be formed on the sheet member 9, and the sheet member 9 after the image formation is conveyed from the image forming device 2 to the main conveyance path 50.

<Steps S103, S104>

When the first punching mode has been selected in step S101, the control portion 7 executes a first conveyance-direction punching process (S103). On the other hand, when the second punching mode has been selected in step S101, the control portion 7 executes a second conveyance-direction punching process (S104). After this, the image formation/punching process ends.

[First Conveyance-Direction Punching Process]

Next, an example of the procedure of the first conveyance-direction punching process executed by the control portion 7 of the punching device 6, is described with reference to the flowchart shown in FIG. 8.

In the following description, S201, S202, . . . are identification signs representing the steps executed by the control portion 7. At the starting point of the first conveyance-direction punching process, the front conveyance roller 32*a* and the rear conveyance roller 51*a* are rotating.

<Step S201>

In the first conveyance-direction punching process, first, the displacement control portion 73 displaces the punching unit 60 to a first reference position on the first-path-side end 50*a* side.

The displacement control portion 73 is configured to identify the position of the punching unit 60 by counting the number of pulses of a driving signal that is output to the displacement motor 650. As described above, the position of the punching unit 60 means the same as the position of the support member 63.

Figure 9:
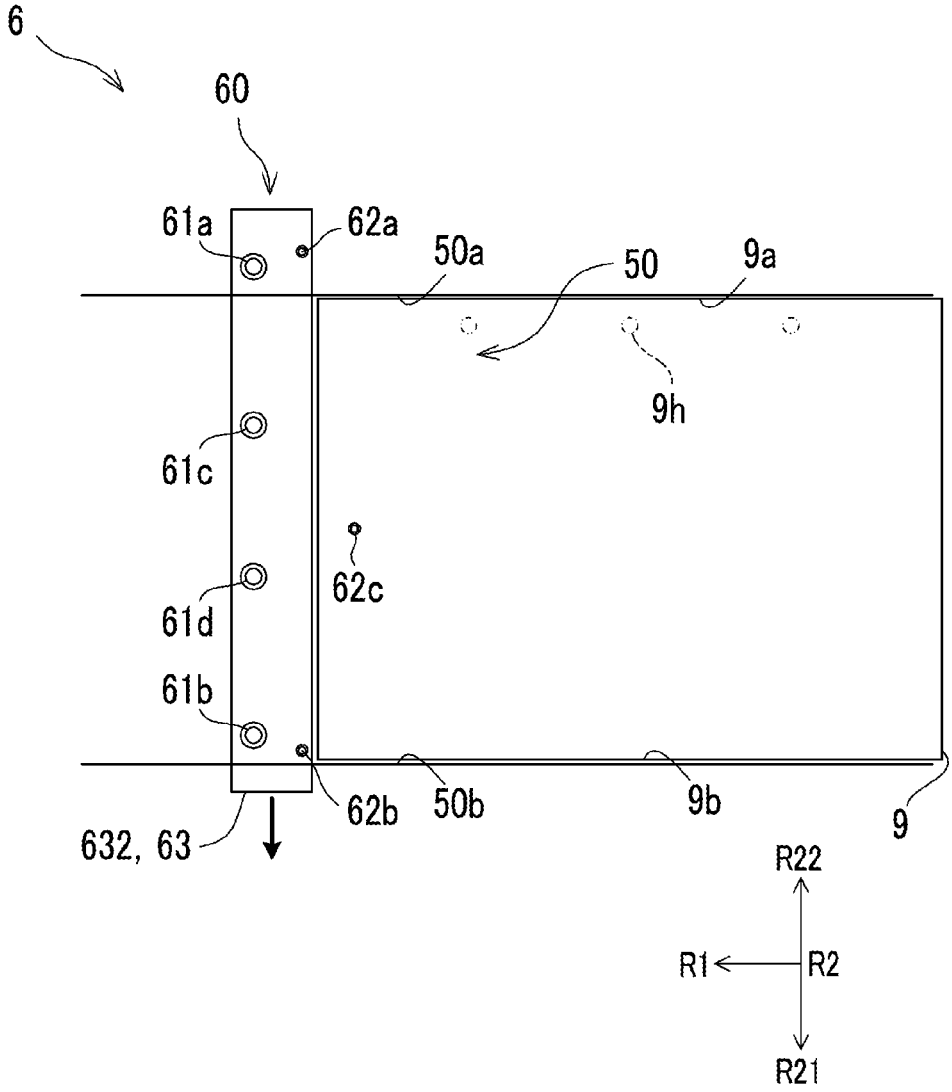
FIG. 9 is a schematic plan view of a part of the punching unit that was displaced to a first reference position before punching during the first conveyance-direction punching process.

FIG. 9 is a schematic plan view of a part of the punching unit 60 that has been displaced to the first reference position before the execution of the punching.

The first reference position is a position when the first sheet sensor 62*a* is more on the first-path-side end 50*a* side than the first edge 9*a* of the sheet member 9. The displacement control portion 73 sets the first reference position based on the width of the sheet member 9 in the second direction R2.

For example, information that identifies the width of the sheet member 9 in the second direction R2 may be set in advance in accordance with an operation performed on the operation/display portion 70. In this case, the information that identifies the width of the sheet member 9 is set in the operation mode setting process (S101) or the like.

The information that identifies the width of the sheet member 9 in the second direction R2 may be included in a print job received from a terminal (not shown). In addition, the width of the sheet member 9 in the second direction R2 may be detected by a sensor (not shown).

It is noted that the first reference position may be a certain position corresponding to the width of the sheet member 9 of the maximum size, regardless of the size of the sheet member 9.

<Step S202>

Next, the displacement control portion 73 monitors whether or not the forward end of the sheet member 9 has been detected by the center sheet sensor 62*c*. The detection result of the center sheet sensor 62*c* is input to the displacement control portion 73 via the conveyance control portion 72.

<Step S203>

Furthermore, after a predetermined forward end wait time has elapsed since the detection of the forward end of the sheet member 9 by the center sheet sensor 62*c*, the displacement control portion 73 displaces the punching unit 60 from the first reference position in the first displacement direction R21.

The forward end wait time is a time required for the forward end of the sheet member 9 that reached the position of the center sheet sensor 62*c*, to reach the position of the first sheet sensor 62*a*, or a time obtained by adding a predetermined time to the above-mentioned time.

<Step S204>

Furthermore, the displacement control portion 73 monitors whether or not the first sheet sensor 62*a* has detected the first edge 9*a* of the sheet member 9.

<Step S205>

Upon detection of the first edge 9*a* of the sheet member 9 by the first sheet sensor 62*a*, the displacement control portion 73 performs a control to stop the punching unit 60 at a first target position.

The first target position is based on the position of the support member 63 at a point of time when the first edge 9*a* is detected by the first sheet sensor 62*a*. The position of the first punching portion 61*a* in the second direction R2 when the punching unit 60 is disposed at the first target position, is the position in the second direction R2 at which the punching holes 9*h* are to be formed in the sheet member 9.

Figure 10:
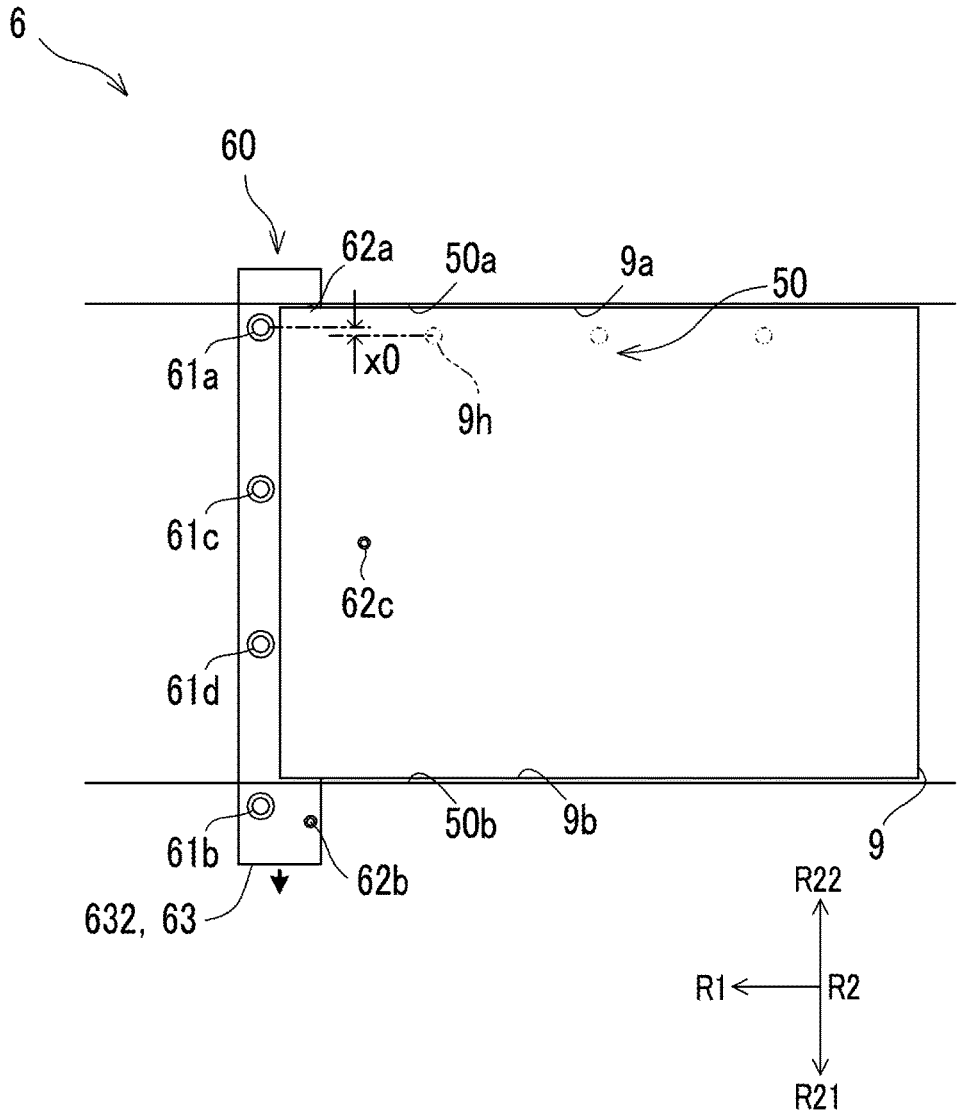
FIG. 10 is a schematic plan view of a part of the punching unit when a first edge of the sheet member was detected during the first conveyance-direction punching process.

FIG. 10 is a schematic plan view of a part of the punching unit when the first edge 9*a* of the sheet member 9 is detected. A set distance x0 in the second direction R2 shown in FIG. 10 is a distance from the position of the support member 63 at a point in time when the first edge 9*a* is detected by the first sheet sensor 62*a*, to the first target position. The set distance x0 is a preset distance.

The displacement control portion 73, starting at the point in time when the first edge 9*a* is detected by the first sheet sensor 62*a*, displaces the punching unit 60 in the first displacement direction R21 by the set distance x0 and stops the punching unit 60. This allows the punching unit 60 to stop at the first target position.

<Step S206>

Upon detection of the first edge 9*a* of the sheet member 9 by the first sheet sensor 62*a*, the conveyance control portion 72 performs a control to stop the sheet member 9 at an $i^{th}$ punching position. The "i" is a variable representing a sequential number of a punching hole 9*h* in the first direction R1, and the initial value there of is 1 (one).

The conveyance control portion 72, starting at the point in time when the forward end of the sheet member 9 is detected by the center sheet sensor 62*c*, conveys the sheet member 9 by a predetermined conveyance distance that has been set in advance for each sequential number (i) of the punching hole 9*h*, and stops the conveyance. A part of the sheet member 9 in which the $i^{th}$ punching hole 9*h* should be formed, overlaps with the front of the first punching portion 61*a*.

It is noted that the punching unit 60 reaches the first target position before the sheet member 9 reaches the $i^{th}$ punching position.

<Step S207>

In the state where the punching unit 60 has reached the first target position and the sheet member 9 has reached the $i^{th}$ punching position, the punching control portion 74 causes the first punching portion 61*a* to operate. This allows the $i^{th}$ punching hole 9*h* to be formed in the sheet member 9.

Figure 11:
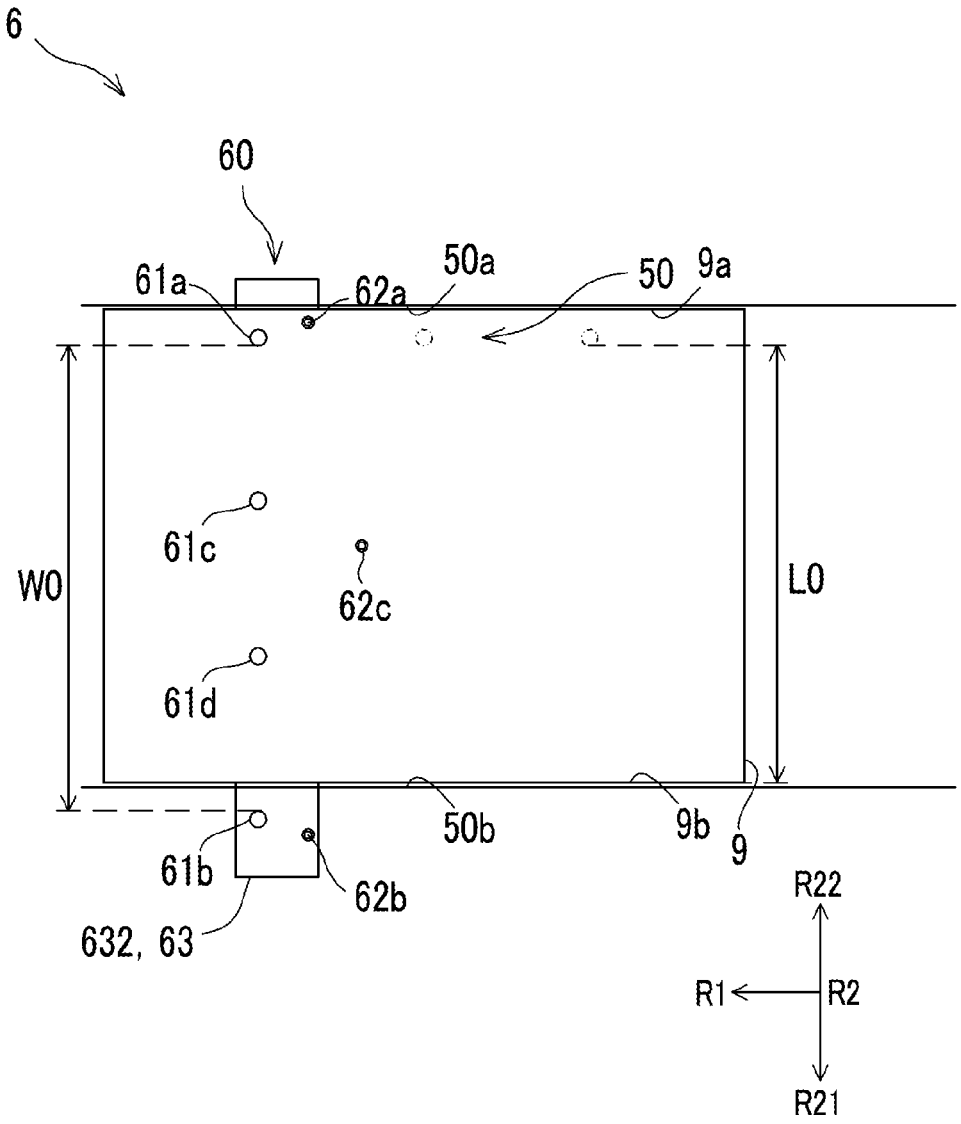
FIG. 11 is a schematic plan view of a part of the punching unit that reached a first target position during the first conveyance-direction punching process.

FIG. 11 is a schematic plan view of a part of the punching unit 60 that has reached the first target position. In the present embodiment, an interval W0 between the first punching portion 61*a* and the second punching portion 61*b* in the second direction R2 is larger than a reference length L0 that corresponds to the maximum size of the sheet member 9.

The reference length L0 is a length from a punching position at one of the first edge 9*a* and the second edge 9*b* that oppose to each other in the sheet member 9 that has the maximum width in the second direction R2, to the other edge. This prevents a punching hole(s) 9*h* from being formed wastefully in the sheet member 9 even in a case where the first punching portion 61*a* and the second punching portion 61*b* operate in conjunction with each other.

<Step S208>

Next, the conveyance control portion 72 counts up the sequential number i of the punching hole 9*h*.

<Step S209>

The conveyance control portion 72 resumes the conveyance of the sheet member 9.

<Step S210>

Furthermore, the conveyance control portion 72 determines whether or not a predetermined ending condition is satisfied. The ending condition is that all punching holes 9*h* have been formed. When the sequential number i of the punching hole exceeds the total number of punching holes 9*h* to be formed, the ending condition is satified.

<Step S211>

When the conveyance control portion 72 determines that the ending condition is not satisfied, the displacement control portion 73 displaces the punching unit 60 to the first reference position on the first-path-side end 50*a* side, as in step S201.

Figure 12:
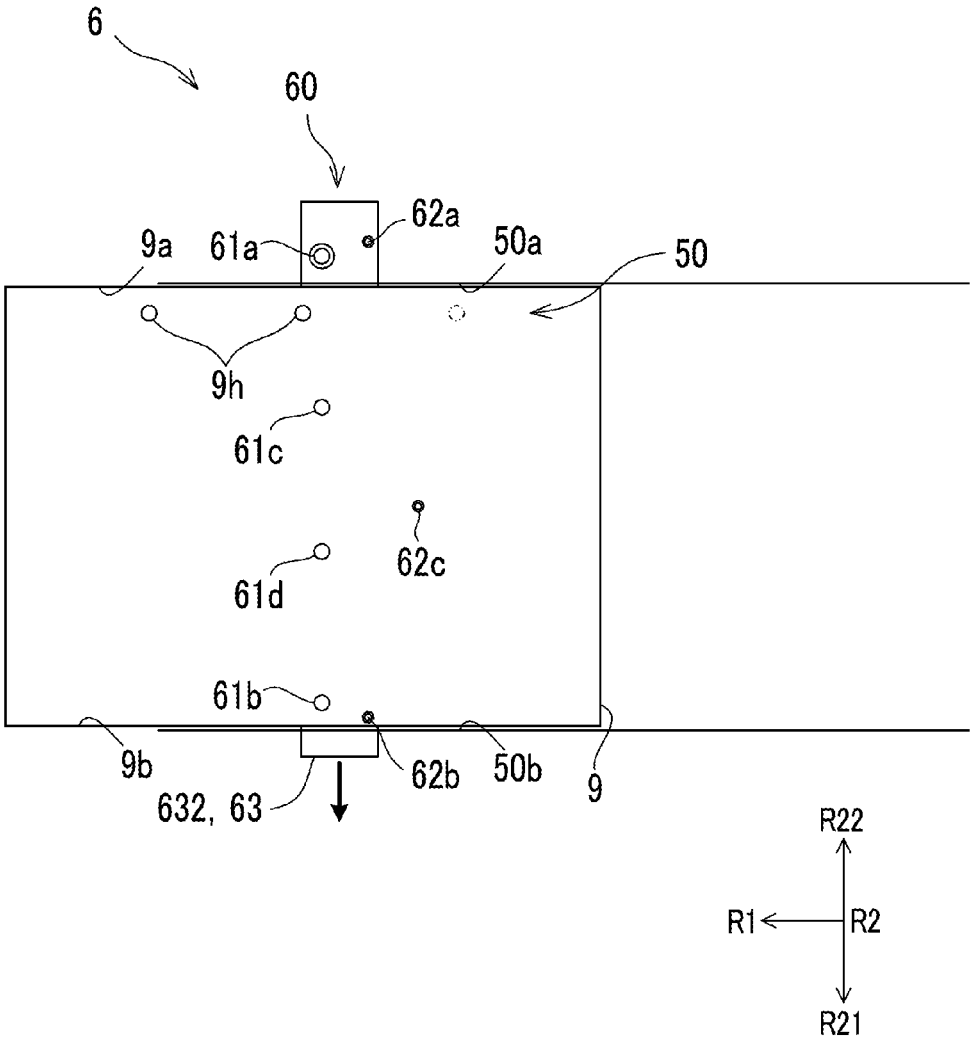
FIG. 12 is a schematic plan view of a part of the punching unit that returned to a first reference position after punching during the first conveyance-direction punching process.

FIG. 12 is a schematic plan view of a part of the punching unit 60 that has returned to the first reference position after punching of the $2^{nd}$ punching hole 9*h* was completed.

Thereafter, the displacement control portion 73, the conveyance control portion 72 and the punching control portion 74 repeat the processes of steps S205 to S210 until the ending condition is satisfied.

On the other hand, when the conveyance control portion 72 determines that the ending condition is satisfied, the first conveyance-direction punching process ends.

As described above, upon selection of the first punching mode, the displacement control portion 73 causes the displacement mechanism 65 including the displacement motor 650 to displace the support member 63 in the first displacement direction R21 (S203). Furthermore, in the state where the support member 63 has reached the first reference position, the punching control portion 74 causes the first punching portion 61*a* to operate (S207).

[Second Conveyance-Direction Punching Process]

Next, an example of the procedure of the second conveyance-direction punching process executed by the control portion 7 of the punching device 6, is described with reference to the flowchart shown in FIG. 13.

The second conveyance-direction punching process differs from the first conveyance-direction punching process in the reference position and the direction in which the punching unit 60 is displaced. In the following, the differences of the second conveyance-direction punching process from the first conveyance-direction punching process are described.

In the following description, S301, S302, . . . are identification signs representing the steps executed by the control portion 7. Steps S301 to S311 correspond to steps S201 to S211 in FIG. 8. At the starting point of the second conveyance-direction punching process, the front conveyance roller 32*a* and the rear conveyance roller 51*a* are rotating.

<Step S301>

In the second conveyance-direction punching process, first, the displacement control portion 73 displaces the punching unit 60 to a second reference position on the second-path-side end 50*b* side.

Figure 14:
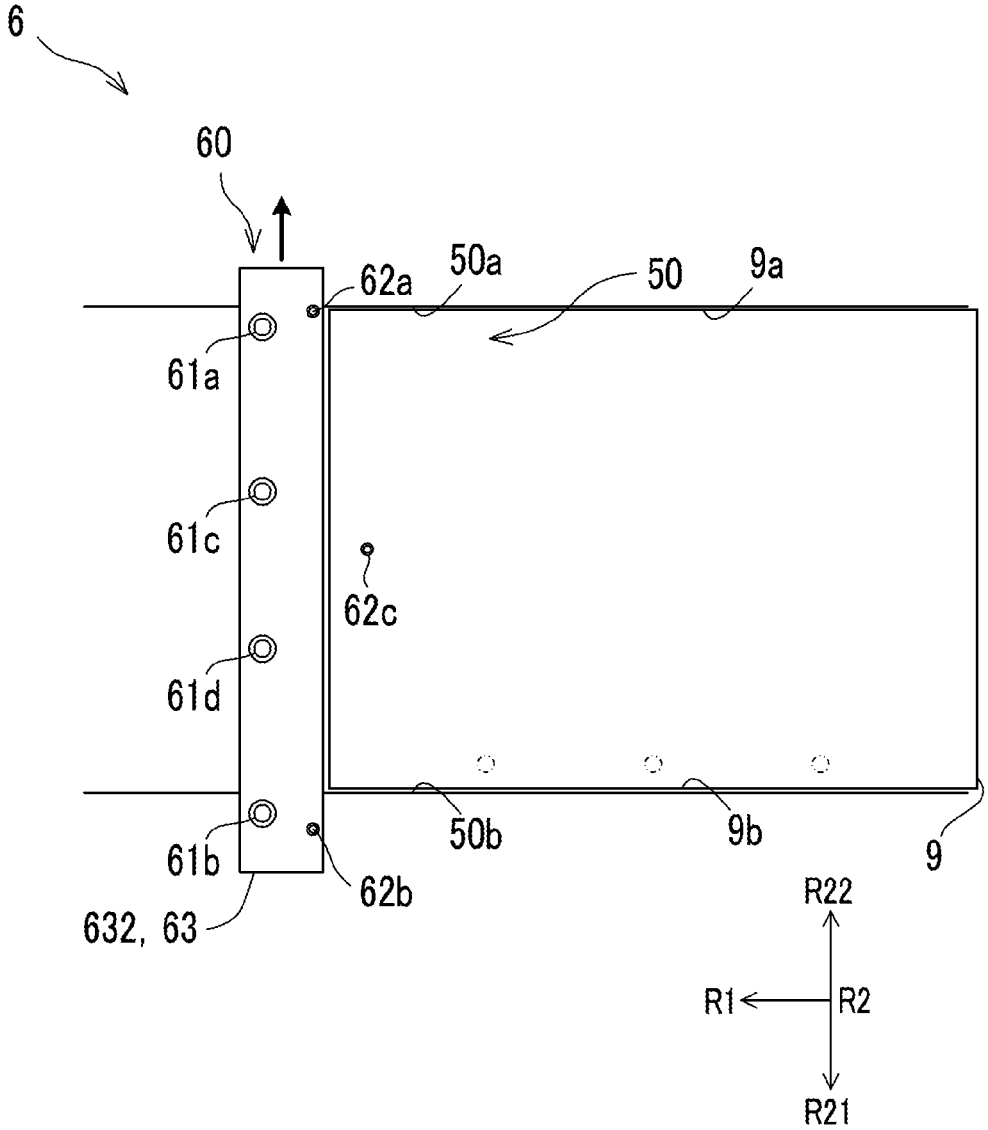
FIG. 14 is a schematic plan view of a part of the punching unit that was displaced to a second reference position before punching during the second conveyance-direction punching process.

FIG. 14 is a schematic plan view of a part of the punching unit 60 that has been displaced to the second reference position before the execution of the punching.

The second reference position is a position when the second sheet sensor 62*b* is more on the second-path-side end 50*b* side than the second edge 9*b* of the sheet member 9. The displacement control portion 73 sets the second reference position based on the width of the sheet member 9 in the second direction R2.

It is noted that the second reference position may be a certain position corresponding to the width of the sheet member 9 of the maximum size, regardless of the size of the sheet member 9.

<Step S302>

Figure 8:
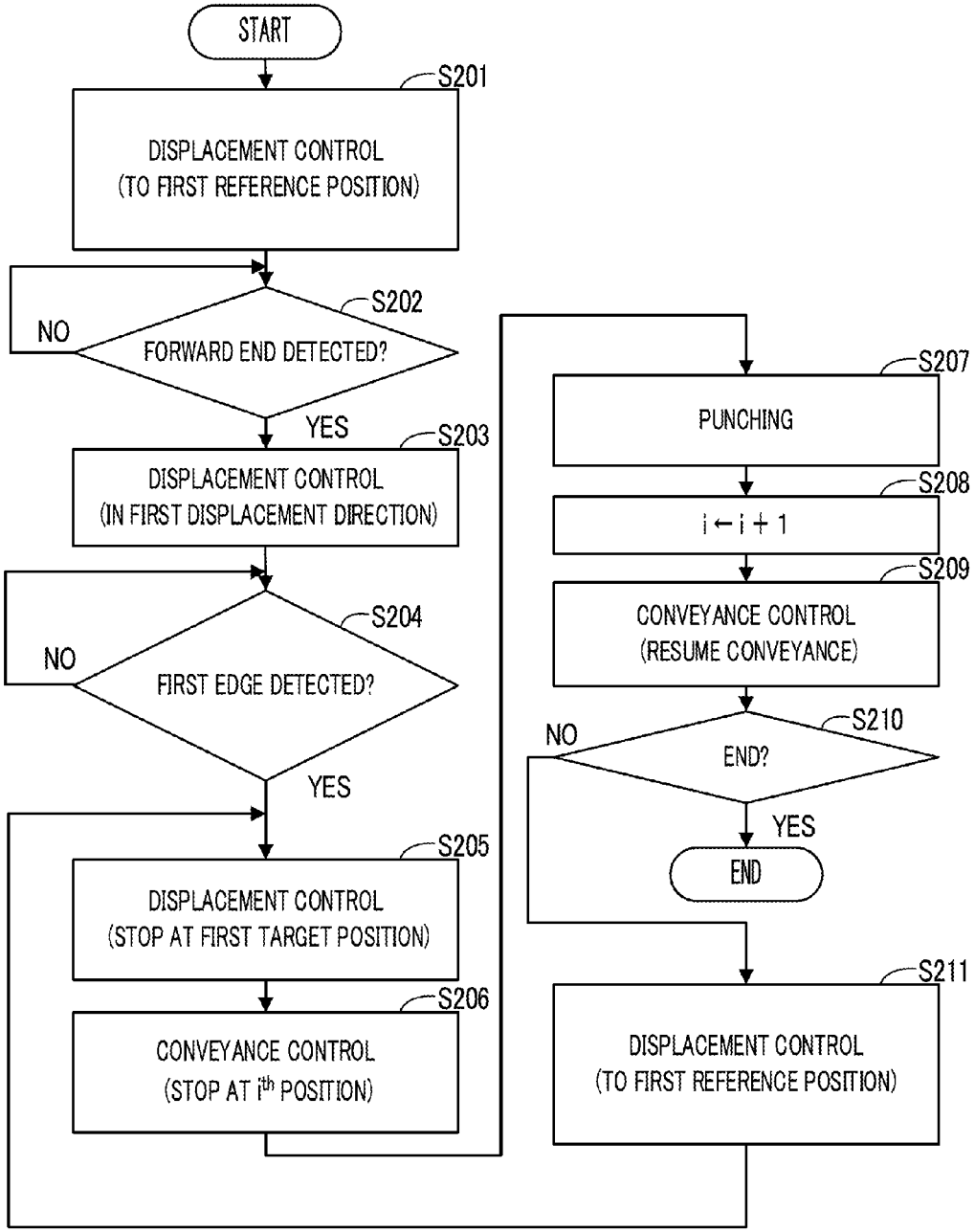
FIG. 8 is a flowchart showing an example of a procedure of a first conveyance-direction punching process in the punching device according to the first embodiment.

Next, the displacement control portion 73, as in step S202 of FIG. 8, monitors whether or not the forward end of the sheet member 9 has been detected.

<Step S303>

Furthermore, as in step S203 of FIG. 8, after the forward end wait time has elapsed since the detection of the forward end of the sheet member 9 by the center sheet sensor 62*c*, the displacement control portion 73 displaces the punching unit 60 from the second reference position in the second displacement direction R22.

<Step S304>

Furthermore, the displacement control portion 73 monitors whether or not the second sheet sensor 62*b* has detected the second edge 9*b* of the sheet member 9.

<Step S305>

Upon detection of the second edge 9*b* of the sheet member 9 by the second sheet sensor 62*b*, the displacement control portion 73 performs a control to stop the punching unit 60 at the second target position.

The second target position is based on the position of the support member 63 at a point of time when the second edge 9*b* is detected by the second sheet sensor 62*b*. The position of the second punching portion 61*b* in the second direction R2 when the punching unit 60 is disposed at the second target position, is the position in the second direction R2 at which the punching holes 9*h* are to be formed in the sheet member 9.

As is the case with the process of step S205 of FIG. 8, the displacement control portion 73, starting at the point in time when the second edge 9*b* is detected by the second sheet sensor 62*b*, displaces the punching unit 60 in the second displacement direction R22 by the set distance x0 and stops the punching unit 60. This allows the punching unit 60 to stop at the second target position.

<Step S306>

Upon detection of the second edge 9*b* of the sheet member 9 by the second sheet sensor 62*b*, the conveyance control portion 72 performs a control to stop the sheet member 9 at the $i^{th}$ punching position. This process is the same as the process of step S206 of FIG. 8.

<Step S307>

In the state where the punching unit 60 has reached the second target position and the sheet member 9 has reached the $i^{th}$ punching position, the punching control portion 74 causes the first punching portion 61*a* to operate. This allows the $i^{th}$ punching hole 9*h* to be formed in the sheet member 9.

<Steps S308 to S310>

Next, the conveyance control portion 72 executes processes that are the same as those of steps S208 to S210 of FIG. 8.

<Step S311>

When the conveyance control portion 72 determines that the ending condition is not satisfied, the displacement control portion 73 displaces the punching unit 60 to the second reference position on the second-path-side end 50*b* side, as in step S301.

Thereafter, the displacement control portion 73, the conveyance control portion 72 and the punching control portion 74 repeat the processes of steps S305 to S310 until the ending condition is satisfied.

On the other hand, when the conveyance control portion 72 determines that the ending condition is satisfied, the second conveyance-direction punching process ends.

As described above, upon selection of the second punching mode, the displacement control portion 73 causes the displacement mechanism 65 including the displacement motor 650 to displace the support member 63 in the second displacement direction R22 (S303). Furthermore, in the state where the support member 63 has reached the second target position, the punching control portion 74 causes the second punching portion 61*b* to operate (S307).

In the present embodiment, the punching device 6 executes the conveyance-direction punching process. As a result, it is possible to perform the punching at a plurality of spots on the sheet member 9 along the longitudinal direction thereof in the state where the sheet member 9 is conveyed longitudinally.

Furthermore, the punching device 6 executes the first conveyance-direction punching process and the second conveyance-direction punching process in distinction from each other, wherein in the first conveyance-direction punching process, the punching holes 9*h* are formed on the first edge 9*a* side, and in the second conveyance-direction punching process, the punching holes 9*h* are formed on the second edge 9*b* side. As a result, a high degree of freedom is provided with regard to the formation position of the punching holes 9*h*, yet it is possible to minimize the maximum displacement width of the punching unit 60 in the second direction R2.

As a result, adoption of the punching device 6 makes it possible to perform the punching at a plurality of spots on the sheet member 9 along the longitudinal direction thereof, with a more compact configuration. In addition, a high degree of freedom is provided with regard to the formation position of the punching holes 9*h*. Furthermore, since the operation time of the displacement mechanism 65 is short, the machine sound and vibration of the sheet processing device 5 generated by operation of the displacement mechanism 65 and movement of the punching unit 60, are restricted.

In addition, in the present embodiment, the detection of the edge of the sheet member 9 (S204, S304) and the positioning of the punching unit 60 based on the detection result thereof (S205, S305) are performed for each punching position. Accordingly, even when the sheet member 9 is conveyed in a state of being inclined with respect to the first direction R1, the punching holes 9*h* are formed at correct positions of the sheet member 9.

[Second Embodiment: Conveyance-Direction Punching Process]

Next, an example of the procedure of the conveyance-direction punching process executed by a control portion of a punching device according to a second embodiment, is described with reference to the flowchart shown in FIG. 15.

The punching device of the second embodiment has the same configuration as the punching device 6. The second embodiment differs from the first embodiment only in that a part of the first conveyance-direction punching process and the second conveyance-direction punching process is omitted.

Figure 15:
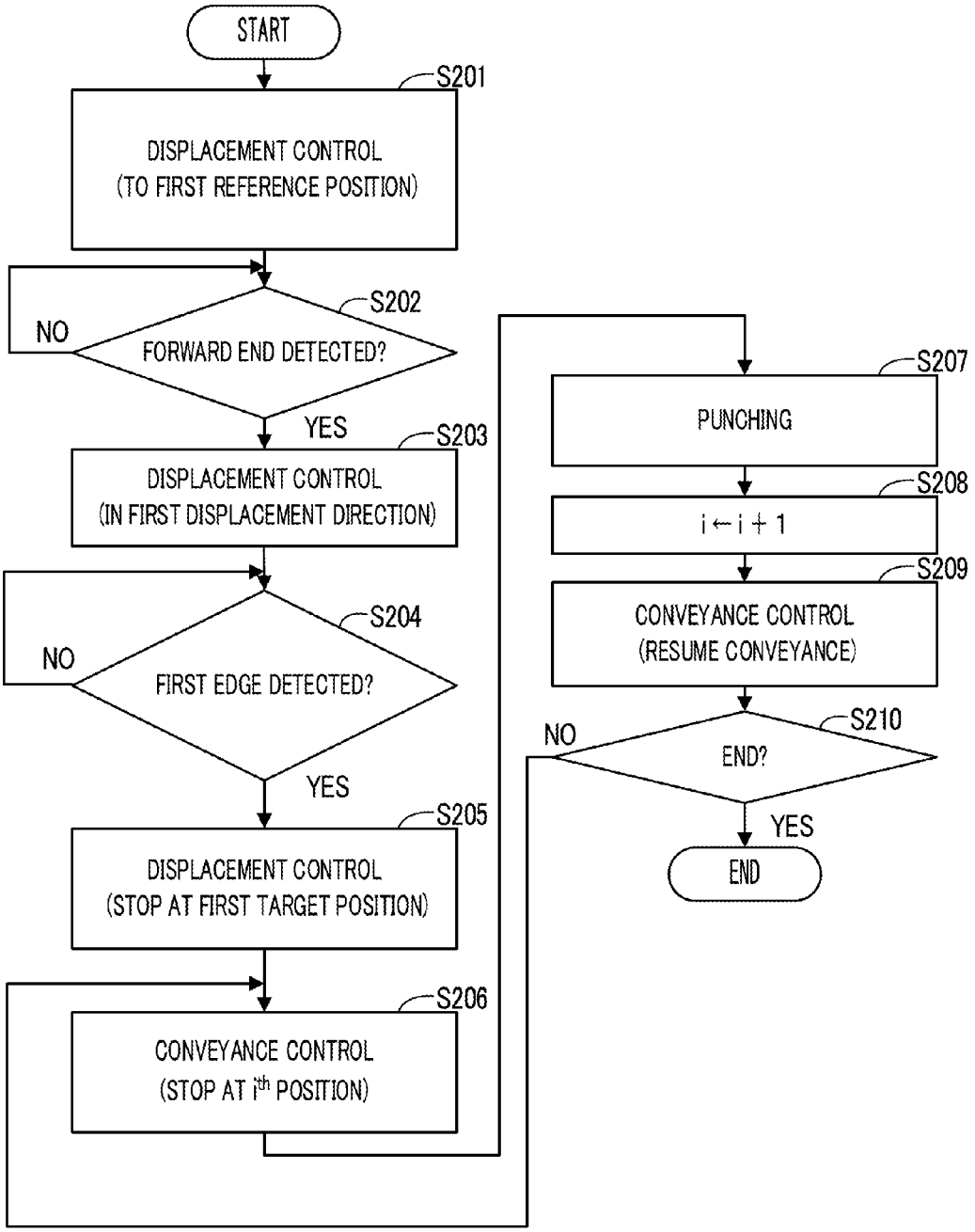
FIG. 15 is a flowchart showing an example of a procedure of a first conveyance-direction punching process in a punching device according to a second embodiment.

The flowchart of FIG. 15 shows an example of the procedure of the first conveyance-direction punching process in the present embodiment. In FIG. 15, steps that are the same as those shown in FIG. 8 are assigned the same identification signs. In the following, the differences from the first embodiment are described.

The first conveyance-direction punching process of the present embodiment is the same as the first conveyance-direction punching process shown in FIG. 8 except that the process of step S211 is omitted.

That is, when the conveyance control portion 72 determines in step S210 that the ending condition is not satisfied, the conveyance control portion 72 and the punching control portion 74 repeat the processes of steps S205 to S210 in a state where the punching unit 60 is held at the first target position at which the punching unit 60 was stopped for the punching at the initial spot.

Figure 13:
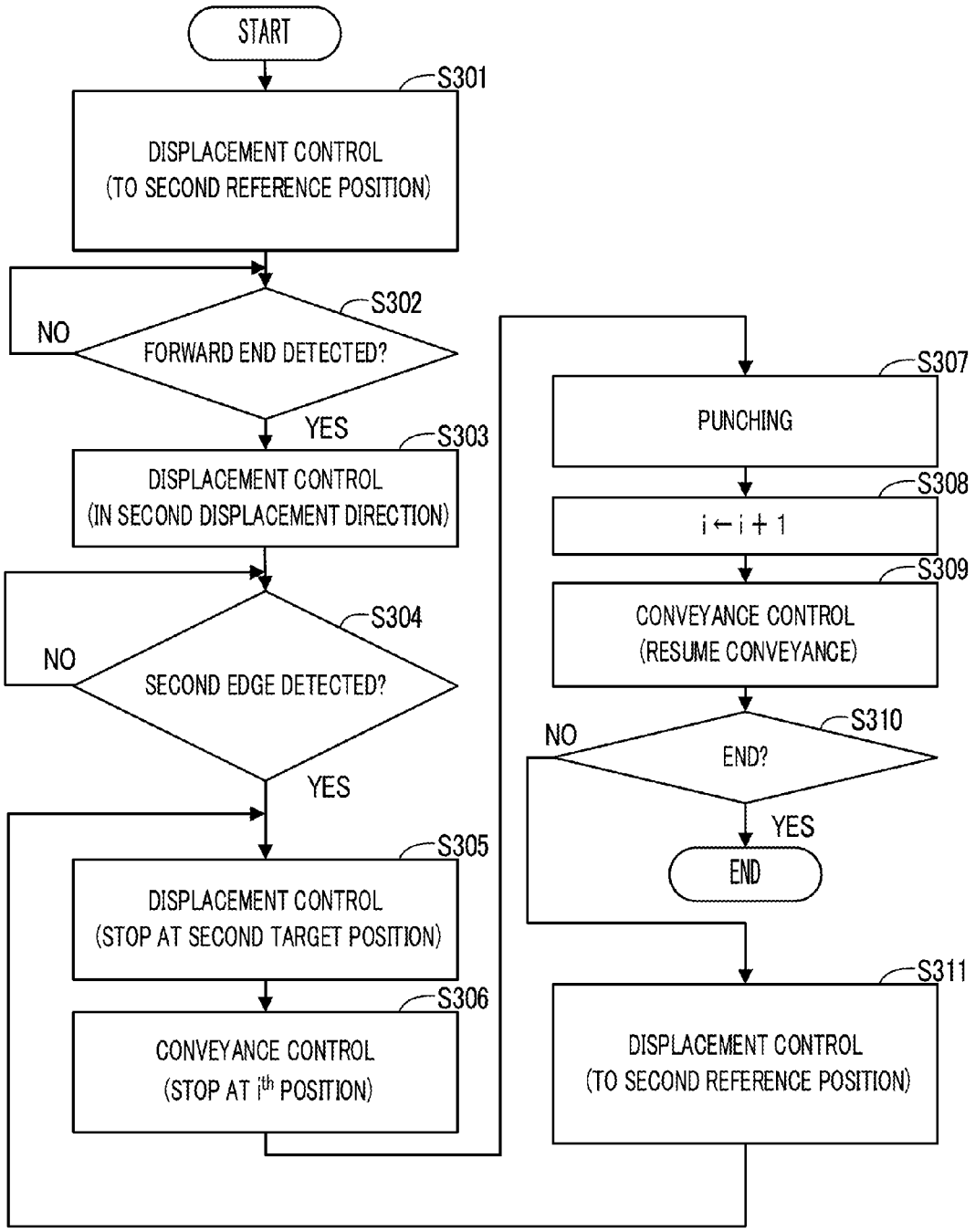
FIG. 13 is a flowchart showing an example of a procedure of a second conveyance-direction punching process in the punching device according to the first embodiment.

In addition, the second conveyance-direction punching process of the present embodiment is the same as the second conveyance-direction punching process shown in FIG. 13 except that the process of step S311 is omitted (not shown).

That is, during the conveyance-direction punching process, when the punching is performed at the initial spot on the sheet member 9, the displacement control portion 73 displaces the punching unit 60 from the first-path-side end 50*a* side or the second-path-side end 50*b* side to the first target position or the second target position (steps S203, S303). Thereafter, the displacement control portion 73 holds the punching unit 60 at the position until the punching at the other spots on the sheet member 9 is completed (step S210 to step S206, step S310 to step S306).

In the present embodiment, the punching unit 60 is displaced a smaller number of times than in the first embodiment. As a result, the machine sound and vibration of the sheet processing device 5 generated by operation of the displacement mechanism 65 and movement of the punching unit 60, are restricted.

It is noted that the UI control portion 71 may select either the first mode or the second mode in accordance with a predetermined selection operation performed on the operation/display portion 70. In a case where the first mode is selected, the displacement control portion 73 executes the process described in the first embodiment, during the conveyance-direction punching process. On the other hand, in a case where the second mode is selected, the displacement control portion 73 executes the process described in the second embodiment, during the conveyance-direction punching process. The first mode is an operation mode that gives priority to the accuracy of the punching position, and the second mode is an operation mode that gives priority to the restriction of the machine sound and the vibration.

[Third Embodiment: Conveyance-Direction Punching Process]

Next, an example of the procedure of the conveyance-direction punching process executed by a control portion of a punching device according to a third embodiment, is described with reference to the flowchart shown in FIG. 16.

The punching device of the third embodiment has the same configuration as the punching device 6. The third embodiment differs from the first embodiment only in that processes of two steps are added to the first conveyance-direction punching process and the second conveyance-direction punching process.

In the present embodiment, a difference from the first embodiment is generated in a case where the conveyance-direction punching process is performed at three or more spots on the sheet member 9.

Figure 16:
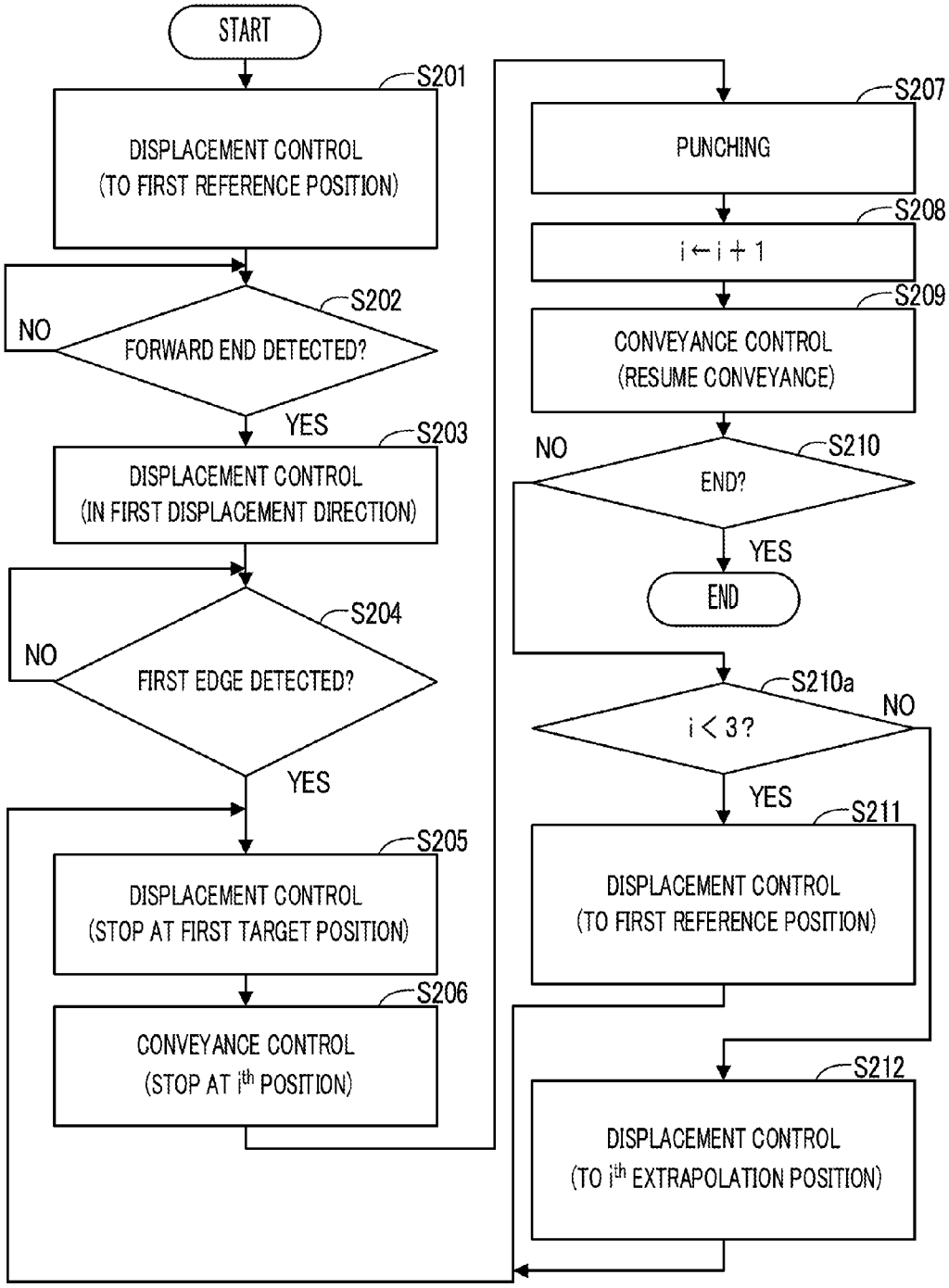
FIG. 16 is a flowchart showing an example of a procedure of a first conveyance-direction punching process in a punching device according to a third embodiment.

The flowchart of FIG. 16 shows an example of the procedure of the first conveyance-direction punching process in the present embodiment. In FIG. 16, steps that are the same as those shown in FIG. 8 are assigned the same identification signs. In the following, the differences from the first embodiment are described.

The first conveyance-direction punching process of the present embodiment is the same as the first conveyance-direction punching process shown in FIG. 8 except that processes of step S210a and step S212 are added.

<Step S210a>

When the conveyance control portion 72 determines in step S210 that the ending condition is not satisfied, the conveyance control portion 72 determines whether or not the punching is in a state where only the first punching hole 9*h* has been formed.

Subsequently, the punching of the second punching hole 9*h* is performed after the punching unit 60 is returned to the first reference position (from step S211 to step S205).

<Step S212>

When the conveyance control portion 72 determines in step S210a that the punching is in a state where the second punching hole 9*h* and onward have been formed, the displacement control portion 73 displaces the punching unit 60 to the $i^{th}$ linear extrapolation position.

The $i^{th}$ linear extrapolation position is a position determined by linear extrapolation based on the positions of the punching unit 60 when the punching is performed at the initial two spots. As described above, the position of the punching unit 60 means the same as the position of the support member 63.

In the present embodiment, the displacement control portion 73 stores the first target positions for the initial two spots at which the punching is performed.

In step S212, the displacement control portion 73 calculates the $i^{th}$ linear extrapolation position corresponding to the $i^{th}$ first target position, by the linear extrapolation based on the stored first target positions for the initial two spots, pitches of the punching holes 9*h* at the initial two spots, and pitches of the $1^{st}$punching hole 9*h* and the $i^{th}$ punching hole 9*h*.

Subsequently, the displacement control portion 73 displaces the punching unit 60 from the current position directly to the linear extrapolation position.

Similarly, in the second conveyance-direction punching process, the displacement control portion 73 calculates the $i^{th}$ linear extrapolation position corresponding to the $i^{th}$ second target position, by the linear extrapolation based on the stored second target positions for the initial two spots, pitches of the punching holes 9*h* at the initial two spots, and pitches of the $1^{st}$ punching hole 9*h* and the $i^{th}$ punching hole 9*h*.

That is, in the present embodiment, the displacement control portion 73 performs the following control during the conveyance-direction punching process performed at three or more spots on the sheet member 9.

First, when the punching is performed at the initial two spots on the sheet member 9, the displacement control portion 73 displaces the punching unit 60 from the first-path-side end 50*a* side or the second-path-side end 50*b* side to the first target position or the second target position (steps S203, S303).

Subsequently, when the punching is performed at the other spots on the sheet member 9, the displacement control portion 73 positions the punching unit 60 to the linear extrapolation position determined based on the positions of the punching unit 60 when the punching is performed at the initial two spots (for example, step S212).

In the present embodiment, too, the punching unit 60 is displaced a smaller number of times than in the first embodiment. As a result, the machine sound and vibration of the sheet processing device 5 generated by operation of the displacement mechanism 65 and movement of the punching unit 60, are restricted.

It is noted that in accordance with a predetermined selection operation performed on the operation/display portion 70, the UI control portion 71 may select either the first mode or the third mode as the operation mode for the conveyance-direction punching process. In a case where the third mode is selected, the displacement control portion 73 executes the process described in the third embodiment, during the conveyance-direction punching process. As is the case with the second mode, the third mode is an operation mode that gives priority to the restriction of the machine sound and the vibration. It is noted that in accordance with a predetermined selection operation performed on the operation/display portion 70, the UI control portion 71 may select any of the first mode, the second mode or the third mode as the operation mode for the conveyance-direction punching process.

APPLICATION EXAMPLES

In the embodiments described above, the support member 63 may support a plurality of first sheet sensors 62*a* and a plurality of second sheet sensors 62*b*. In that case, the plurality of first sheet sensors 62*a* and the plurality of second sheet sensors 62*b* are disposed at intervals along the second direction R2.

In addition, in the conveyance-direction punching process, the first sheet sensor 62*a* or the second sheet sensor 62*b* that is closest to the first edge 9*a* or the second edge 9*b* of the sheet member 9 is used for detection of the edge of the sheet member 9.

According to the above-described application example, the displacement range of the punching unit 60 can be reduced further. As a result, it is possible to make the apparatus more compact, and restrict the machine sound and vibration further.

In addition, in the punching device 6, each of distances in the first direction R1 from the centers of the first punching portion 61*a* and the second punching portion 61*b* to the rotation center of the rear conveyance roller 51*a* may be shorter than a shortest imaginable sheet end to hole length.

The sheet end to hole length is a length from the forward end of the sheet member 9 to the center of a punching hole 9*h* that is formed closest to the forward end of the sheet member 9 in the conveyance-direction punching process. This allows the punching of all punching holes 9*h* to be performed in a state where the position of the sheet member 9 in the first direction R1 has been adjusted by the rear conveyance roller 51*a*.

For example, the shortest imaginable sheet end to hole length is a sheet end to hole length in the conveyance-direction punching process in which four punching holes 9*h* are formed in one sheet member 9.

It is noted that the punching device and the image forming system of the present invention may be configured by freely combining, within the scope of claims, the above-described embodiments and application examples, or by modifying the embodiments and application examples or omitting a part thereof.

In addition, in the punching device 6, the second punching portion 61*b* and the second sheet sensor 62*b* on the second-path-side end 50*b* side may be omitted. In this case, the operation mode setting process (S101) by the UI control portion 71 is omitted, too.

The invention claimed is:

1. A punching device comprising:

a support member facing a conveyance path of a sheet member conveyed in a first direction, and formed to extend from a position close to one of a first-path-side end and a second-path-side end to a position close to the other, the first-path-side end being a first side end of the conveyance path in a second direction perpendicular to the first direction, the second-path-side end being a second side end of the conveyance path in the second direction;

a displacement mechanism configured to cause the support member to be displaced reciprocally along the second direction;

a first sheet sensor supported on the support member at a position close to the first-path-side end and configured to, when the support member is displaced, detect a first edge of the sheet member that is located on the first-path-side end side;

a second sheet sensor supported on the support member at a position close to the second-path-side end and configured to detect, when the support member is displaced, a second edge of the sheet member that is located on the second-path-side end side;

a first punching portion supported on the support member at a position close to the first-path-side end and configured to perform punching on the sheet member;

a second punching portion supported on the support member at a position close to the second-path-side end and configured to perform punching on the sheet member;

a punching mode selection portion configured to select a first punching mode or a second punching mode, wherein in the first punching mode, a conveyance-direction punching process is executed on a part of the sheet member that is on the first edge side, and in the second punching mode, the conveyance-direction punching process is executed on a part of the sheet member that is on the second edge side; and a control portion configured to cause the displacement mechanism, the first punching portion, and the second punching portion to execute the conveyance-direction punching process, wherein in the conveyance-direction punching process, the punching is performed on the sheet member in sequence at a plurality of spots along the first direction, in a case where the first punching mode has been selected, the control portion causes the displacement mechanism to displace the support member from the first-path-side end side to the second-path-side end side, and causes the first punching portion to operate in a state where the support member has reached a first target position, in a case where the second punching mode has been selected, the control portion causes the displacement mechanism to displace the support member from the second-path-side end side to the first-path-side end side, and causes the second punching portion to operate in a state where the support member has reached a second target position, the first target position is based on a position of the support member at a point of time when the first edge is detected by the first sheet sensor, and the second target position is based on a position of the support member at a point of time when the second edge is detected by the second sheet sensor.

2. The punching device according to claim 1, wherein the first punching portion and the second punching portion operate in conjunction with each other, and an interval between the first punching portion and the second punching portion in the second direction is larger than a length from a punching position at one of the first edge and the second edge of a sheet member having a maximum width in the second direction, to the other of the first edge and the second edge.

3. The punching device according to claim 1, wherein during the conveyance-direction punching process, when the punching is performed at an initial spot on the sheet member, the control portion displaces the support member from the first-path-side end side or the second-path-side end side to the first target position or the second target position, and then holds the support member at that target position until the punching at the other spots on the sheet member is completed.

4. The punching device according to claim 1, wherein during the conveyance-direction punching process performed at three or more spots on the sheet member, when the punching is performed at initial two spots on the sheet member, the control portion displaces the support member from the first-path-side end side or the second-path-side end side to the first target position or the second target position, and then positions the support member at a position that is determined by linear extrapolation based on positions of the support member when the punching is performed at the initial two spots.

5. A sheet processing device that comprises the punching device according to claim 1 that performs punching on the sheet member conveyed from an image forming apparatus that forms an image on the sheet member.

6. An image forming system comprising:

an image forming apparatus configured to form an image on a sheet member; and the sheet processing device according to claim 5.

* * * * *